United States Patent [19]

Groves, Jr. et al.

[11] 4,071,897

[45] Jan. 31, 1978

[54] POWER PLANT SPEED CHANNEL SELECTION SYSTEM

[75] Inventors: Charles L. Groves, Jr., Willingboro, N.J.; Steven J. Johnson, McCandless Township, Allegheny County, Pa.

[73] Assignee: Westinghouse Electric Corporation, Pittsburgh, Pa.

[21] Appl. No.: 713,176

[22] Filed: Aug. 10, 1976

[51] Int. Cl.[2] ..... F01K 13/02; H02P 9/04

[52] U.S. Cl. ..... 364/494; 364/110; 60/660; 290/40 A; 415/17

[58] Field of Search ..... 235/151, 151.21; 444/1; 60/660; 290/40 R, 40 A; 318/653; 415/15-17

[56] References Cited

U.S. PATENT DOCUMENTS

| | | | |
|---|---|---|---|
| 3,859,007 | 1/1975 | Kowalski et al. | 60/660 X |
| 3,965,684 | 6/1976 | Nomura | 60/660 |
| 4,016,723 | 4/1977 | Farley | 235/151.21 X |
| 4,028,532 | 6/1977 | Reuther | 235/151.21 X |

*Primary Examiner*—Edward J. Wise

*Attorney, Agent, or Firm*—H. W. Patterson

[57] ABSTRACT

A turbine control system incorporating a speed monitoring system for generating an actual turbine speed measurement for control of turbine speed and load is disclosed. The speed monitoring system employs two identical speed channels each of both analog and digital form and a third channel of only analog form. The two identical speed channels of digital form and the third channel of analog form are coupled to a programmed digital computer based process controller for use in controlling turbine speed and load. The two identical speed channels of analog form and the third channel are coupled to an overspeed protection controller for use in preventing turbine overspeed. Within each controller, an identical channel is selected without preference to be used as the actual turbine speed measurement. A transfer between identical speed channels will only be performed if a malfunction is detected in that identical channel utilized as the actual turbine speed measurement. This transfer will be performed without affecting the operation of the turbine as controlled by either of the two controllers. The malfunction of any two of the input channel forms to a respective controller disables only the speed control function of that controller.

17 Claims, 11 Drawing Figures

ANALOG SCAN PROGRAM 206

LOGIC PROGRAM 210

POWER PLANT SPEED CHANNEL SELECTION SYSTEM

CROSS-REFERENCE TO RELATED APPLICATION

"Speed Measurement System for a Turbine Power Plant" by Earl T. Farley, Ser. No. 624,351, filed Oct. 21, 1975 and assigned to the present assignee is incorporated for reference herein for the purposes of disclosing the details of a conversion means.

BACKGROUND OF THE INVENTION

1. Field of the Invention

The present invention relates to a steam turbine power plant and more particularly to a digital electro-hydraulic (DEH) turbine control system which incorporates an improved speed monitoring system for generation of an actual turbine speed measurement signal for controlling turbine speed and load.

2. Prior Art Discussion

A DEH turbine control system, presently in use, uses a programmed digital computer to output position setpoints to servo loops associated with control of the steam inlet valves to accelerate the turbine from turning gear to line frequency, and to control the load output of the turbine once the turbine power plant has been coupled to the power system network. To effectively protect and control the turbine through a startup and while on-line, process variables are scanned by various input systems of the digital computer system, and are used to determine the operation of the turbine in response to steam inlet valve stimuli. Turbine speed is one such process variable. This single process variable is used within the DEH not only to affect automatic closed loop turbine speed control during startup but also to establish varying protective limits on vibration, eccentricity, acceleration, heat soak periods and even the transfer of control from throttle valves to governor valves. Loss of this crucial turbine speed information to the programmed digital computer of the DEH would disable the automatic turbine speed control and activate the transfer of steam inlet valve control to a degraded backup analog manual system. Therefore, it is evident that the turbine speed measurement is one of the most essential of the monitored process variables and the importance of a speed monitoring system for the generation of a highly reliable and available turbine speed measurement is paramount.

Copending patent application Ser. No. 722,779 entitled "Improved System and Method for Operating a Steam Turbine and Electric Power Generating Plant" filed by Giras and Birnbaum on Apr. 4, 1968, and continued as Ser. No. 124,993 on Mar. 16, 1971, and Ser. No. 319,115 on Dec. 29, 1972 discloses a DEH turbine control system with a programmed digital computer, an overspeed protection controller, and a degraded backup analog manual system, to which reference is made for a more detailed understanding of a DEH turbine control system. A typical overspeed protection controller for a steam turbine generator is more specifically described in U.S. pat. No. 3,643,437. Also, a typical degraded analog backup manual system is more specifically described in U.S. Pat. No. 3,741,246. The latter patent also describes the transfer operation associated with transferring control of steam inlet valves from the programmed digital computer to the degraded backup analog manual system and vice versa. The analog backup system is used to increase the availability of control of the steam turbine. The overspeed protection controller (OPC) is incorporated within the DEH to operate independently of the programmed digital computer to anticipate a possible overspeed condition and protect the turbine plant by rapid closure of the steam inlet and reheat control valves.

Speed information is detected through three speed transducers located in close proximity to a notched surface on the turbine shaft. Each speed transducer is a primary source of speed information for a particular controller or instrument. For example, one speed transducer signal is converted to digital form and coupled to the programmed digital computer. A second speed transducer signal is converted to analog form and coupled to the overspeed protection controller and finally, the third speed transducer signal is coupled to a speed monitoring supervisory instrument where it is converted to an analog form. The OPC and supervisory instrument analog speed channels are also coupled to the programmed digital computer through its analog input system. The speed monitoring system of the digital computer selects one of the three speed readings as the actual turbine speed measurement. In this selection the primary digital speed channel is always given preference. The OPC analog speed reading is chosen as the secondary or backup speed measurement. Only if a malfunction is detected in the digital speed reading will the secondary analog speed reading be selected. The supervisory instrument analog speed reading is used as a reference in the digital computer to determine a malfunction in either of the other two speed readings. Because of the three different conversion methods and interface techniques employed to couple these speed readings to the programmed digital computer, under certain conditions these speed readings will not be of the same value.

It is possible for a number of undesirable effects in turbine operations to occur as a result of the primary-secondary priority selection in combination with unequal speed readings. As one example, should the digital speed channel incur an intermittent malfunction, then an oscillating condition could exist in selecting between the digital and the OPC analog speed channels. The programmed digital computer will respond to the falsely varying actual speed measurement by continually trying to correct steam flow to convert the actual speed measurement to that desired of the power plant operator, thus compounding the problem by producing a disturbing oscillatory valve movement and steam flow. Another example occurs in the transfer from throttle valve to governor valve steam inlet control, which is governed by an actual turbine speed measurement value. Just prior to this transfer speed point, temperature readings are taken to determine the temperature gradient in the steam flow between the throttle valves and governor valves. If the temperature gradient is not within predetermined limits, the transfer will not be permitted and the turbine speed will be maintained at the transfer speed point. Should a malfunction in speed channel occur around this point, the transfer from one speed reading to another could affect a change in actual speed measurement such that a throttle valve to governor valve transfer would be permitted to take place without first checking the temperature gradient criteria.

The OPC as described in the aforementioned references is governed by only one analog speed reading. In this controller, a malfunction of speed channel is determined by checking the speed reading against predetermined high and low physical operational limits. A problem may arise because the predetermined overspeed limit is within this operational range. If the analog speed channel should happen to malfunction and drift between the OPC predetermined limit and the high malfunction limit, an overspeed action could be performed. This is a safe method of operation, but could undesirably initiate an OPC action. This problem condition can be resolved by improving the speed monitoring system of the OPC such that it may perform the same speed monitoring functions as the programmed digital computer.

SUMMARY OF THE INVENTION

The present invention is a turbine control system which controls the speed and load of the turbine in accordance with an actual speed measurement signal as generated by a speed monitoring system. Two identical transducers are used to detect turbine speed as established by a notched surface located on the turbine shaft. Identical speed signals from the two speed transducers are coupled to two identical conversion means wherein each speed transducer signal is converted respectively into both a digital and an analog form to provide two identical speed channels of both analog and digital form. A third speed transducer is employed by the speed monitoring supervisory instrument wherein the speed transducer signal is converted to an analog form. The two identical speed channels of digital form along with the third supervisory speed channel are coupled to the programmed digital computer of the DEH. The two identical channels of analog form along with the third supervisory speed channel are coupled to the OPC of the DEH turbine control system. In each of the two aforementioned controllers, an identical channel is initially selected without preference to be used as the actual turbine speed measurement for control of turbine speed and load. Transfer between the two identical speed channels will only occur if a malfunction is detected in that identical speed channel which is being utilized as the actual turbine speed measurement. The present invention provides for effecting a transfer between channels in one controller without disturbing the operation of the other controller. In addition, transferring between identical channels will not alter the turbine operation as controlled by either controller. If a malfunction is detected in any two of the speed channels going to a respective controller, that controller will disable its turbine speed control function.

DESCRIPTION OF THE PREFERRED EMBODIMENT

Figure 1:
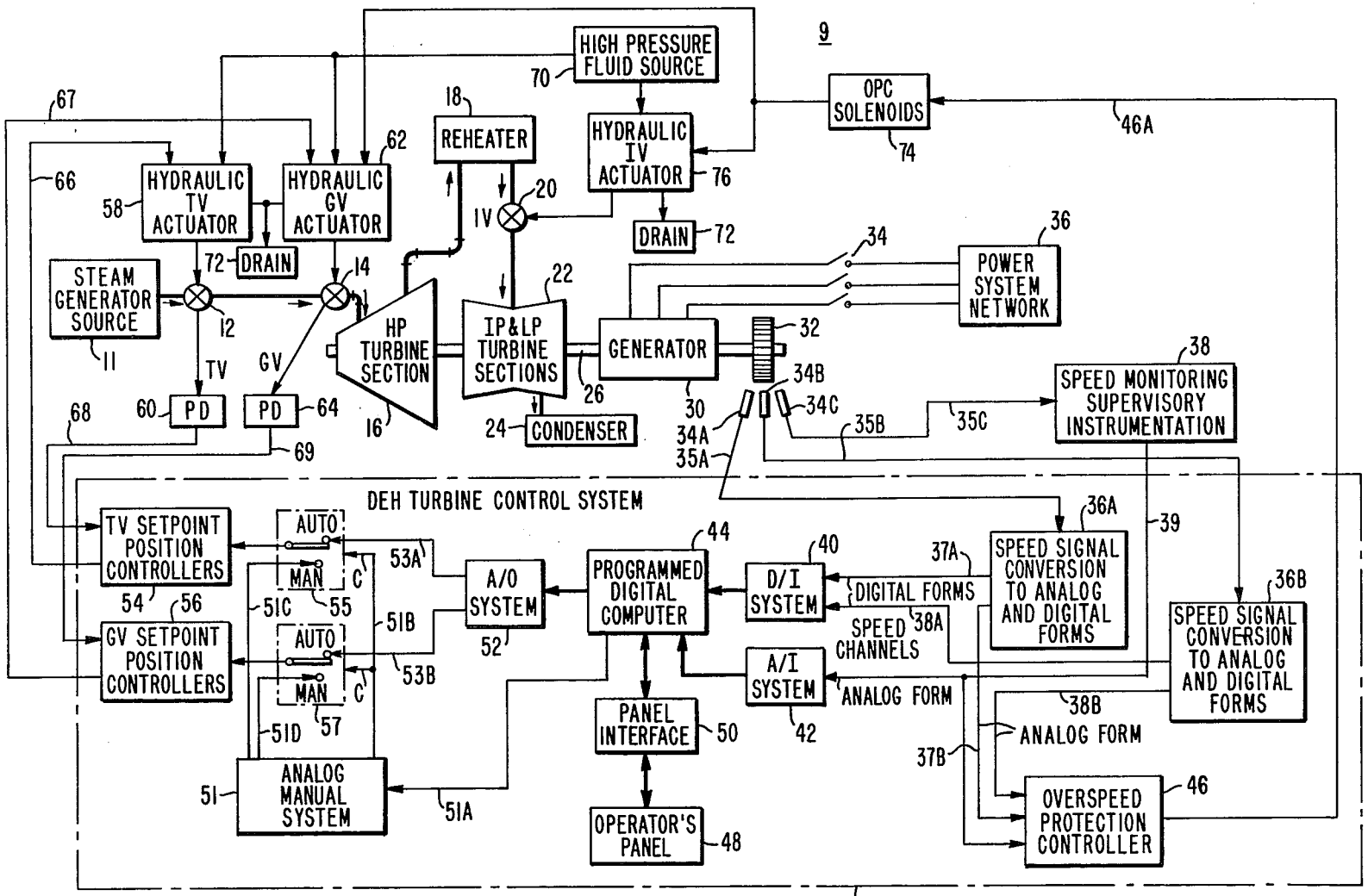
FIG. 1 is a schematic block diagram of a steam turbine power plant and a digital electrohydraulic (DEH) turbine control system embodying the present invention.

Referring to FIG. 1, a steam turbine power plant generally referred to at 9 is controlled by a digital electrohydraulic (DEH) turbine control system within the dashed lines 10. The power plant 9 includes a steam generating source 11 to generate steam, which flows through a plurality of steam inlet throttle valves (TV) 12 and a plurality of governor valves (GV) 14 into a high pressure (HP) turbine section 16. Exiting from the HP section 16, the steam flows through a reheater 18, and then through reheat control valves or interceptor valves (IV) 20, into intermediate pressure (IP) and low pressure (LP) sections of the turbine 22, and finally exhausts into a condenser 24. As the steam passes through the HP and IP–LP turbine sections 16 and 22, its energy is transferred to turbine blading attached to a turbine shaft 26 thus producing a torque on the shaft 26. The shaft 26 in turn drives an alternating current generator 30 which supplies power to a power system network 36 through main breakers 34. With the main breakers 34 open, the torque as produced by the inlet steam is used to accelerate the turbine shaft 26 from turning gear to synchronous speed. This mode of control is generally referred to as start-up. Once the shaft frequency is synchronized to the frequency of the power system network 36, the breakers 34 are closed, and power is delivered to the power system network 36 by the generator 30. With the breakers 34 closed, the net torque exerted on the turbine rotating assemblies of the HP and IP–LP turbine sections 16 and 22 controls only the amount of power supplied to the power system network 36, while the shaft speed is governed by the frequency of the power system network 36. Control of steam inlet under these conditions is generally referred to as load control. During load control, the turbine speed is monitored for purposes of regulating the power delivered to the power system network 36.

The DEH system 10 includes a programmed digital computer 44 which controls the speed and load of the turbine power plant 9. The program organization and execution schedule of the digital computer 44 described in connection with FIG. 4 may be similar to that disclosed in U.S. Pat. No. 3,934,128, titled "System and Method for Operating a Steam Turbine With Improved Organization of Logic and Other Functions In a Sampled Data Control" by Robert Uram, issued Jan. 20, 1976, which is incorporated as a reference herein for a more detailed understanding thereof. The digital computer may be of the type manufactured by Westinghouse Electric Corporation under the trade name W2500 and a more detailed description of such a computer can be found in the Westinghouse Computer and Instrumentation Division (CID) publication No. 25REF-001D titled "W2500 Computer Reference Manual." The speed and load of the turbine power plant 9 is typically controlled through operator's panel 48 via a panel interface 50 of the digital computer 44 as disclosed in the referenced U.S. Pat. No. 3,934,128. In response to panel instructions via the panel interface 50, the digital computer 44 controls the speed and load of the power plant by periodically outputting through its analog output (A/O) subsystem 52 a new TV position setpoint and GV position setpoint over lines 53A and 53B. The A/O subsystem 52 may be of the type manufactured and sold by Westinghouse CID under the trade names "Direct Input/Output Subsystem" (IODS) and "Digital/Analog Hybrid Coupler Card" (NHC) more than one year prior to the filing of this application. The position setpoint signals on lines 53A and 53B are coupled to a TV position controller 54 and a GV position controller 56 through switches 55 and 57, which are shown in FIG. 1 in the "AUTO" position.

Each position controller 54 and 56 continuously serves its respective steam inlet valve position to equal its input position demand as dictates by the digital computer 44 through its A/o subsystem 52. Typically, the TV position controller 54 outputs a control signal 66 to a conventional TV hydraulic actuator 58 to affect movement of the TV valves 12. Attached to the TV valves 12 is a position detector 60 which generates a position feedback signal on line 68 connected to the TV position controller 54 thus completing the TV valve position servo loop. The GV valve position servo loop operates in an identical manner utilizing its position controller 66, hydraulic actuator 62, control line 67, position detector 54 and feedback line 69. The hydraulic actuators 58 and 62 incorporate a high pressure fluid source 70 and a drain 72 to effect movement of valves TV 12 and GV 14 in response to control signals on lines 66 and 67, respectively. A typical construction, assembly and method of closed loop control of the throttle and governor valves is disclosed in the referenced U.S. Pat. No. 3,934,128. Movement of the steam inlet valves TV 12 and GV 14 will create a change in steam flow through the HP and IP–LP sections 16 and 22 of the turbine. During start-up, the steam flow change will result in an increase or decrease of speed of the turbine shaft 26. Under load control, the power supplied to the power system network 36 will vary as a result of any steam flow change.

In the present embodiment, turbine speed is detected by a plurality of identical speed transducers 34A, 34B and 34C utilizing the movement of a notched surface 32 attached to the turbine shaft 26. The speed transducers may be variable reluctance magnetic sensors of the type manufactured by Electro Corporation, Model No. 3040A. The notched surface 32 is more specifically a toothed-wheel having 60 teeth milled around its periphery. Each tooth is approximately 161 mils in arc length and each adjacent notch or groove is 250 mils in arc length. The speed transducers 34A, 34B and 34C are located a predetermined distance from the toothed surface so as to produce an approximate sinusoidal output waveform in response to movement of the toothed wheel 32. The frequency of the sinusoidal waveform is proportional to turbine speed. The output signals on lines 35A and 35B are coupled to conversion circuits 36A and 36B, respectively, described hereafter. The output signal on line 35C is coupled to a speed monitoring supervisory device 38 wherein the signal 35C is converted to an analog signal on line 39 with a magnitude range from 0 to 4V, in correspondence to a turbine speed range of 0 rpm to 125% of rated speed, for example. The speed supervisory instrument or device 38 may be of the type manufactured by Westinghouse under the trade name of W Turbograf Model M300. The conversion circuits 36A and 36B convert their respective input speed signals on lines 35A and 35B to both a digital form on lines 37A and 38A, and an analog form on line 37B and 38B.

The digital form signals on line 37A and 38A are coupled to the digital computer 44 through its digital input (D/I) subsystem 40. The analog signal on line 39 produced by the supervisory instrument 38 is also coupled to the digital computer 44 through its analog input (A/I) subsystem 42. The D/I subsystem 40 may be of the type manufactured and sold by Westinghouse Electric Corporation under the trade name "Direct Input-/Output Subsystem (IODS)" more than one year prior to the filing of this application. Subsystem 42 may be of the type manufactured and sold by Westinghouse under the trade name of "40 Point-Per-Second Analog/Digital Subsystem," more than one year prior to the filing of this application.

The three speed signals on lines or channels 37A, 38A and 39 are scanned by the programmed digital computer 44 periodically. A speed monitoring function is performed under program control within the digital computer 44 to check each speed channel 37A, 38A and 39 for proper operation. If all channels 37A, 38A and 38 are found to be operating properly, then either speed channel 37A or 38A is selected without preference to be used as the actual turbine speed measurement. The speed control error being the difference between the desired speed signal, as entered through the operator's panel 48 via panel interface 50 to the digital computer 44, and the actual turbine speed measurement is operated on by a speed control program within the digital computer 44 periodically to establish the new TV 12 and GV 14 position setpoints as outputted through A/0 subsystem 52 over lines 53A and 53B, respectively.

Should the speed monitoring funcion of the digital computer 44 determine that any two of the speed channels 37A, 38A or 39 have malfunctioned, a "revert-to-manual" indication is given to the analog manual system 51 over the control line 51A. Upon reception of the "revert-to-manual" signal 51A, the analog manual system 51 directs the switches 55 and 57 to the MAN position thereby permitting control of the TV setpoint position controller 54 and GV setpoint position conroller 56 by the analog manual system 51 over control lines 51C and 51D, respectively. The analog manual system 51 and its interaction with the digital computer 44 as used in this embodiment may be the same as that disclosed in the U.S. Pat. No. 3,891,344 titled "Steam Turbine System With Digital Computer Position Control Having Improved Automatic-Manual Interaction" by A. S. Braytenbah, issued June 24, 1975 to which reference is made for a more detailed understanding thereof.

The three speed signals on lines or channels 37B, 38B and 39 are coupled to overspeed protection controller (OPC) 46. A speed monitoring function is performed within the OPC 46 to check each speed channel 37B, 38B and 39 for proper operation. If all channels 37B, 38B and 39 are found to be operating properly, then either speed channel 37B or 38B is selected without preference to be used as the actual turbine speed measurement within the OPC 46. This actual speed measurement is compared to a predetermined turbine overspeed value. If the measurement is greater than the overspeed value, a control signal 36A will de-energize the OPC solenoids 74. The de-energization of the OPC solenoids 74 causes the hydraulic fluid control lines of the hydraulic IV actuator 76 and hydraulic GV actuator 62 to be dumped to drain which produces a rapid closure of valves IV 20 and GV 14. With the closure of valves IV 20 and GV 14, steam flow is interrupted from flowing through the HP and IP–LP 16 and 22 sections of the turbine. A typical OPC 46 and associated assemblies which may be used in the present embodiment is described in detail in U.S. Pat. No. 3,643,437 titled "Overspeed Protection System For a Steam Turbine Generator" by Birnbaum, et al, issued Feb. 22, 1972. In accordance with the present invention, the speed monitoring function as governed by the three speed channels 37B, 38B and 39 produce an actual speed measurement for use in the OPC 46 as hereafter described.

Figure 2:
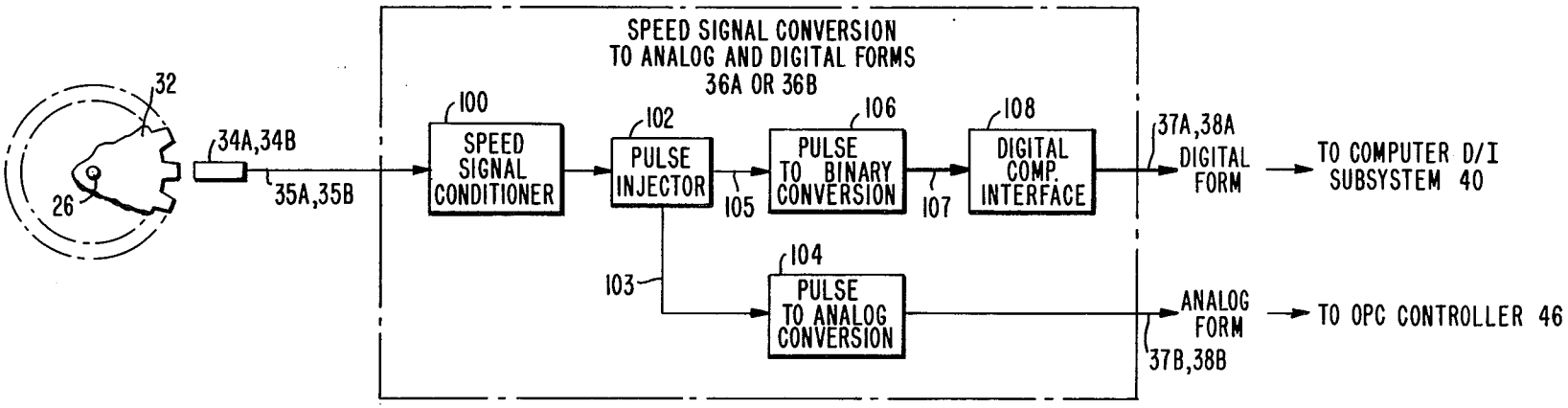
FIG. 2 is a schematic block diagram of the apparatus for providing identical speed channels to one embodiment of the invention, and suitable for use in the system of FIG. 1.

FIG. 2 schematically shows the apparatus for generating speed signals on channels 37A, 38A, which are identical; signals on 37B, 38B, which are also identical. As previously mentioned, a 60 toothed wheel 32 is attached to a turbine shaft 26 to provide a means to detect the turbine speed. Variable reluctance type magnetic sensors 34A, 34B, are positioned from the toothed wheel 32 and perpendicular to its periphery. The sensors 34A, 34B generate an approximate sinusoidal waveform in response to movement of the wheel teeth wherein each individual sine wave period represents the influence of a tooth of the wheel 32 passing the magnetic sensors 34A, 34B. The waveform is inputted to the speed signal conditioner 100 of the speed signal converter 36A, 36B over signal line 35A, 35B. The speed signal conditioner produces a speed pulse for each zero crossing of the speed signal sine wave while protecting against and rejecting unwanted noise which may have been coupled to signal line 35A, 35B. The speed pulses produced by conditioner 100 are inputted to a pulse injector 102 wherein three additional pulses are injected into the train of speed pulses with the occurrence of each speed pulse. The time interval over which the speed pulse and three additional speed pulses occur is maintained constant. Only the time between occurrence of speed pulses will vary proportionately with turbine speed.

A constant time interval pulse is produced by the pulse injector 102 at each occurrence of a speed pulse as provided by the conditioner 100 and is coupled to the pulse-to-analog converter 104 over signal line 103. Within the converter 104, an analog switch (not shown) is enabled to pass a precision reference direct current signal to a filtering network (not shown) with each occurrence of the constant time interval pulse as provided by the pulse injector 102. In this manner, the analog switch is operative with a duty cycle proportional to turbine speed. The resultant switched signal is averaged by the filtering network to produce a d.c. voltage proportional to turbine speed. A gain is selected within the filtering network of converter 104 to scale the d.c. voltage output on 37B, 38B, as the case may be, such that a range of 0 to 10V is representative of an actual turbine speed range of 0 to 125% of rated speed.

The pulse train comprising speed pulses and injected pulses as produced by pulse injector 102 is inputted to the pulse-to-binary converter 106 over signal line 105. The pulses over signal line 105 are accumulated into a 13 bit binary counter (not shown) within the converter 106 over a fixed predetermined time interval. The number of pulses accumulated at the end of the time interval directly determines the binary form proportional to turbine speed. At the end of each time interval, the 13 bit binary counter information is transferred to a storage register in the digital computer interface 108 over signal line 107 and then the binary counter is cleared to begin a new count. The digital computer interface 108 provides a 13 bit binary digital signal over signal line 37A, 38A to the D/I subsystem 40 upon request of the digital computer 44 (FIG. 1).

A detailed description of the signal converters 36A, 36B is given in the copending referenced patent application to Farley which is incorporated herein by reference.

Figure 3:
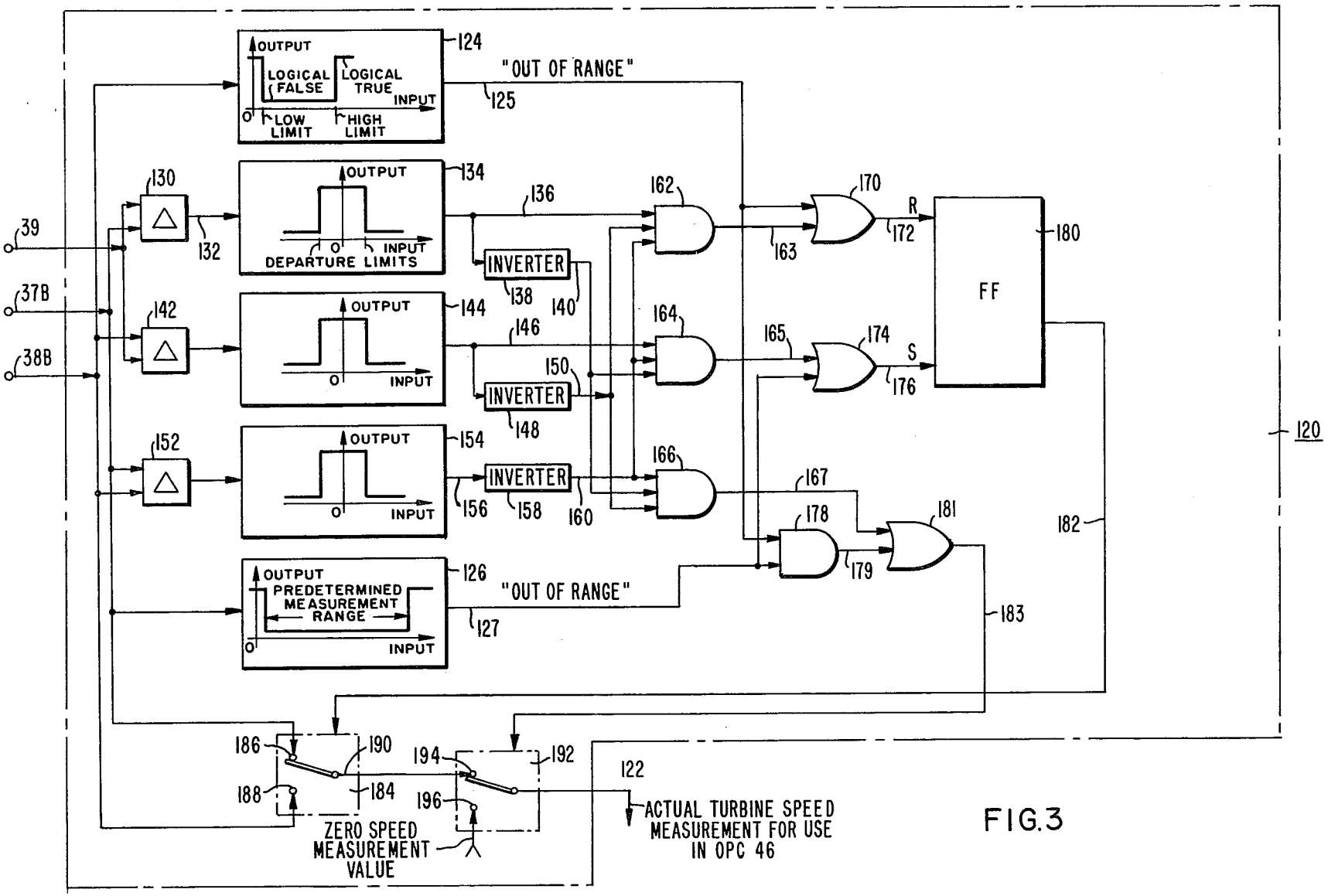
FIG. 3 is a functional block diagram of the OPC portion of the speed monitoring system in accordance with the embodiment of the present invention.

The speed monitoring system 120 is governed by the speed channel signals 39, 37B and 38B to generate an actual turbine speed measurement 122 within the OPC 46 is functionally illustrated in FIG. 3. Speed channel 38B is coupled to a window comparator function 124 wherein the magnitude of channel 38B is compared with predetermined low and high limits. The window comparator 124 will output a logical true "out-of-range" signal 125 should the magnitude of 38B fall outside the range as determined by the low and high limit values. Otherwise the "out-of-range" signal 125 will be logically false. Likewise, speed channel 37B is coupled to window comparator function 126 and in a similar manner an output "out-of-range" signal 127 is produced. A logical true "out-of-range" signal either 125 or 127 indicates a speed channel malfunction in that a speed signal 38B or 37B respectively is outside the predefined measurement range of the speed channel. The supervisory speed channel 39 and speed channel 37B are inputted to the difference function 130. The resulting difference signal 132 is inputted to a window comparator function 134 wherein it is compared to a pair of predetermined departure limits as referenced to a zero difference. The window comparator function 134 outputs a logical true signal 136 which denotes an equality designation if the difference signal 132 is within the predetermined departure limits of the window comparator function 134. The inverter function 138 produces a signal 140 from signal 136 which is logical true when the difference signal 132 is outside the limits of comparator 134 conventionally referred to as denoting not equality ("$\overline{\text{equality}}$"). The speed monitoring system 120 similarly provides the functions to determine "equality" 146 and "$\overline{\text{equality}}$" 150 for speed channels 38B and 39 through utilization of the difference function 142, the window comparator function 144 and the inverter 148 and likewise, "equality" 156 and "$\overline{\text{equality}}$" 160 for speed channels 37B and 38B through utilization of difference function 152, the window comparator function 154 and the inverter 158.

An "and" gate 162 in the speed monitoring system 120 inputs the "equality" signal 136, the "$\overline{\text{equality}}$" signal 150 and the "$\overline{\text{equality}}$" signal 160 and produces a logical true signal 163 only when all of its inputs are logically true. The logical true signal 163 indicates that speed channel 38B has departed in value from speed channels 37B and 39 beyond the preselected departure limits of window comparator functions 144 and 154 and that the remaining two speed channels 37B and 39 are still within the departure limits of window comparator function 134 whereby speed channel 37B is considered operational and 38B is considered malfunctioning. And "and" gate 164 inputs the "$\overline{\text{equality}}$" signal 140, the "equality" signal 146 and the "$\overline{\text{equality}}$" signal 160 and produces a logical true signal 165 only when all of its inputs are logically true. The logical true signal 165 indicates that speed channel 37B has departed in value from speed channels 38B and 39 beyond the preselected departure limits of window comparator functions 134 and 154 and that the remaining two speed channels 38B and 39 are still within the departure limits of window comparator function 144 whereby speed channel 38B is considered operational and 37B is considered malfunctioning. An "and" gate 166 inputs the "equality" signal 140, the "equality" 150 and the "equality" 160 and produces a true logical signal 167 when all of its inputs are logically true. The logical true signal 167 indicates that all the speed channels 37B, 38B and 39 have departed from each other in value as determined by the window comparator functions 134, 144 and 154 whereby at least two of the speed channels are considered malfunctioning.

An R–S flip-flop (FF) 180 is governed by its reset 172 and set 176 inputs to produce a control signal 182 in a conventional manner. The control signal 182 governs the switch position of a single-pole-double-throw (SPDT) type analog switch 184. The reset input 172 is produced by "or" gate 170 and is logically true if either signals 125 or 163 or both signals 125 and 163 are logically true. The logical true reset signal 172 indicates malfunctioning of speed channel 38B and resets the control signal 182 to a logical false state. The set input 176 is produced by "or" gate 174 and is logically true if either signals 127 or 165 or both signals 127 and 165 are logically true. The logical true set signal 176 indicates malfunctioning of speed channel 37B and sets the control signal 182 to a logical true state.

Speed channel signal 37B is coupled to one position 186 of the SPDT switch 184 and speed channel 38B is coupled to another position 188 of the SPDT switch 184. When the control signal 182 is logically false, the SPDT switch 184 is activated to the switch position 186 and when signal 182 is logically true, the switch 184 is operated to the position 188.

An "and" gate 178 produces a logical true signal 179 only if both its inputs 125 and 127 are logically true indicating that both speed channels 37B and 38B are malfunctioning. An "or" gate 181 produces a logical true signal 183 if either of its input signals 179 or 167 or both 179 and 167 are logically true indicating that at least two speed channels have malfunctioned. The signal 183 governs the operation of a SPDT type analog switch 192. A signal 190 from switch 184 is coupled to one position 194 of switch 192 and another position 196 of switch 192 is coupled to a zero speed measurement signal. The output of switch 192 is the actual turbine speed measurement signal 122 for use in the OPC 46.

As an example of operation of the speed monitoring system 120 of the OPC 46, let us assume that speed channel 37B has been initially selected as the actual turbine speed measurement 122 with all channels functional and that speed channel 37B now malfunctions by departing from the other two speed channels 38B and 39. The "equality" signals 140 and 160 will go from logical false to logical true states in response to "equality" signals 136 and 156 going from logical true to logical false states as determined by window comparators 134 and 154. The "and" gate 164 being responsive to all inputs logically true will produce a logical true output signal 165 which shall direct "or" gate 174 to likewise produce a logical true signal 176 which sets the output signal 182 of FF 180 from a logical false state to a logical true state. The SPDT analog switch 184 being responsive to control signal 182 will transfer from switch position 186 to switch position 188, thus signal 190 will transfer coupling from speed channel 37B to channel 38B. Since only one speed channel has malfunctioned, "or" gate 181 will not be responsive and its output 183 will remain logically false whereby maintaining conduction of switch 192 through switch position 194. In this example, the actual turbine speed measurement 122 has been switched from speed channel 37B to speed channel 38B upon detection of a malfunction in 37B by its departure from the other two speed channels 38B and 39.

Assuming that the state of the speed monitoring system remained the same as it was in the previous example and that the speed channel 37B returned within the departure limits of the other two channels 38B and 39, the "and" gate 164 will respond to its new input state and produce a logical false output signal 165 which in turn directs "or" gate 174 to affect a logical false signal 176 on its output. Since the FF 180 is of the conventional R–S type, it will not respond to its set signal 176 changing state if the output signal 182 of the FF 180 has already been set logically true which was accomplished in the previous example. The SPDT switch 184 will remain undisturbed wherein the actual speed measurement signal will remain responsive to speed channel 38B even though speed channel 37B has become functional. The operation of the previous examples presents clearly the principle of selecting a speed channel without preference to be used as the actual speed measurement in accordance with the present embodiment.

A similar operation such as that described in the previous example would have occurred if the speed channel 38B malfunctioned by departing from the other two speed channels 37B and 39 and that the actual speed measurement signal 122 was responsive to speed channel 38B. The malfunction in 38B is detected by "and" gate 162 causing its output 163 to go logically true thus affecting the output 172 of "or" gate 170 to go logically true. The FF 180 will respond to a logical true reset signal 172 by changing the state of its output 182 from logical true to logical false. The SPDT switch 184 being controlled by signal 182 transfers its pole signal 190 from switch position 188 to switch position 186. The actual turbine speed measurement 122 is now responsive to speed channel 37B. Similarly, as described in the previous example, should speed channel 38B become functional no transfer of speed channels will occur and the actual turbine speed measurement 122 will remain responsive to speed channel 37B.

As an example of the operation of at least two speed channels malfunctioning, let us assume that all three speed channels 37B, 38B and 39 have departed in value beyond their respective departure limits with either 37B or 38B having been selected as the actual speed measurement 122. The "equality" outputs 136, 146 and 156 will all respond to a logical false state as determined by the window comparator functions 134, 144 and 154 respectively. The "equality" signals 140, 150 and 160 will all respond to a logical true state as established through the inverters 138, 148 and 158 respectively. The "and" gate 166 will respond to all of its inputs being logically true by producing a logical true output signal 167. The "or" gate 181 will produce a logical true output signal 183 in response to its logical true input 167. The SPDT switch 192 is governed by the signal 183 to transfer its pole signal 122 from switch position 194 to switch position 196. The actual turbine speed measurement 122 being no longer responsive to either speed channel 37B or 38B is set equal to a zero speed measurement value thus disabling any possibility of an overspeed protective action as previously described above. The disabling operation as described in this example is performed within 4 to 5 milliseconds which is faster than the response times of the OPC solenoid 74 and IV and GV hydraulic actuators 76 and 62, respectively. Therefore, the OPC is disabled upon detection of at least two channels malfunctioning without affecting rapid closure of the IV 20 and GV 14 reheat and inlet steam control valves.

Implementation of the function of the speed monitoring system 120 of FIG. 3 may be accomplished using conventional circuit components. The difference functions 130, 142 and 152 may be performed by conventional differential amplifiers of the type described in section 6.1.1. of the text titled "Operational Amplifiers, Design and Application" published by Burr Brown Corporation in 1971, for example. The window comparator functions 124, 134, 144, 154 and 126 are typical of those shown, for example, on page 163 of the manual titled "Linear Integrated Circuits" published by National Semiconductor Corporation in June, 1972. The SPDT analog switches 190 and 192 may be, for example, of the type described on page 18 of the data sheet No. 860A published by C. P. Clare and Co. The logic may be implemented with integrated circuit packages similar to those described in the "Signetics Data Manual," published by Signetics Corporation in 1976, for example, wherein the inverters 138, 148 and 158 are on page 55; the "and" gates 162, 164, 166 and 178 are on page 59; the "or" gates 170, 174 and 181 are on page 66; and finally, the R-S flip-flop is of the variety as described on page 221 of such publication. The aforementioned conventional circuits are interconnected as shown in FIG. 3.

Figure 4:
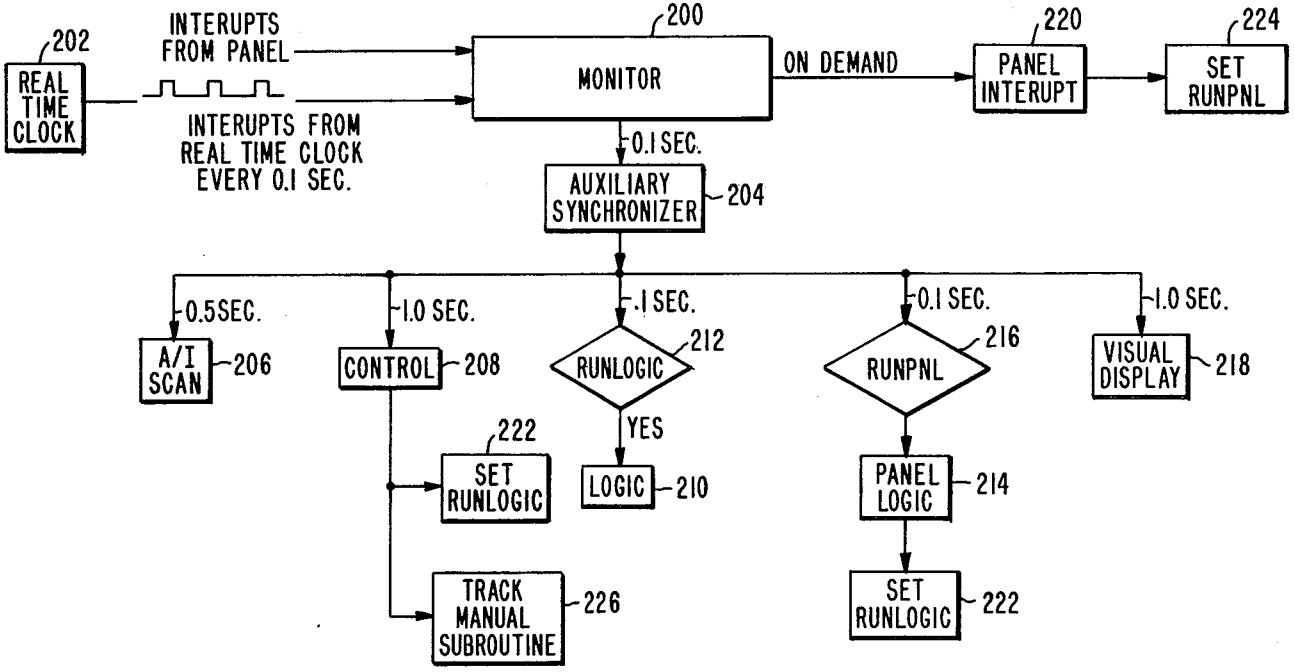
FIG. 4 is a diagram which illustrates the execution of programs within the digital computer of the DEH for purposes of controlling speed and load in the present invention.

Referring to FIG. 4, a typical simplified organization and scheduling of execution of the program for the digital computer 44 of the DEH provides for a monitor 200 which functions in cooperation with a real time clock 202 to execute an auxiliary synchronizer program 204 every 0.1 second. The auxiliary synchronizer 204 controls the execution of other programs with a priority schedule. An A/I scan program 206 is executed every 0.5 seconds; a control program 208 is executed every 1.0 second wherein a set runlogic function 222 or track manual subroutine 226 may be run; a runlogic flag 212 is checked every 0.1 second; if the flag 212 is set by one of the other programs, a logic program 210 is executed, otherwise it is not executed; a runpnl flag 216 is checked every 0.1 second; if the runpnl flag 216 is set, a panel logic program 214 is executed, otherwise it is not executed; the panel logic program 214 may also set the runlogic flag 212 using the set runlogic function 222; a visual display program 218 is executed every 1.0 second. Interrupts are generated by commands initiated from the operator's panel 48 via panel interface 50. A service subroutine within the monitor 200 determines the source of the interrupt and executes the panel interrupt program 220. The set runpnl flag function 224 is executed within the interrupt program 220.

Those portions of the programs within the digital computer 44 utilized for speed monitoring and producing an actual speed measurement for use in controlling turbine speed and load, in accordance with one embodiment of the present invention, are shown in the Fortran flowcharts of FIGS. 5, 6, 7A through 7D and 8. The program listing of the embodiment as presented by the Fortran flowcharts is found in the Appendix herein.

Figure 5:
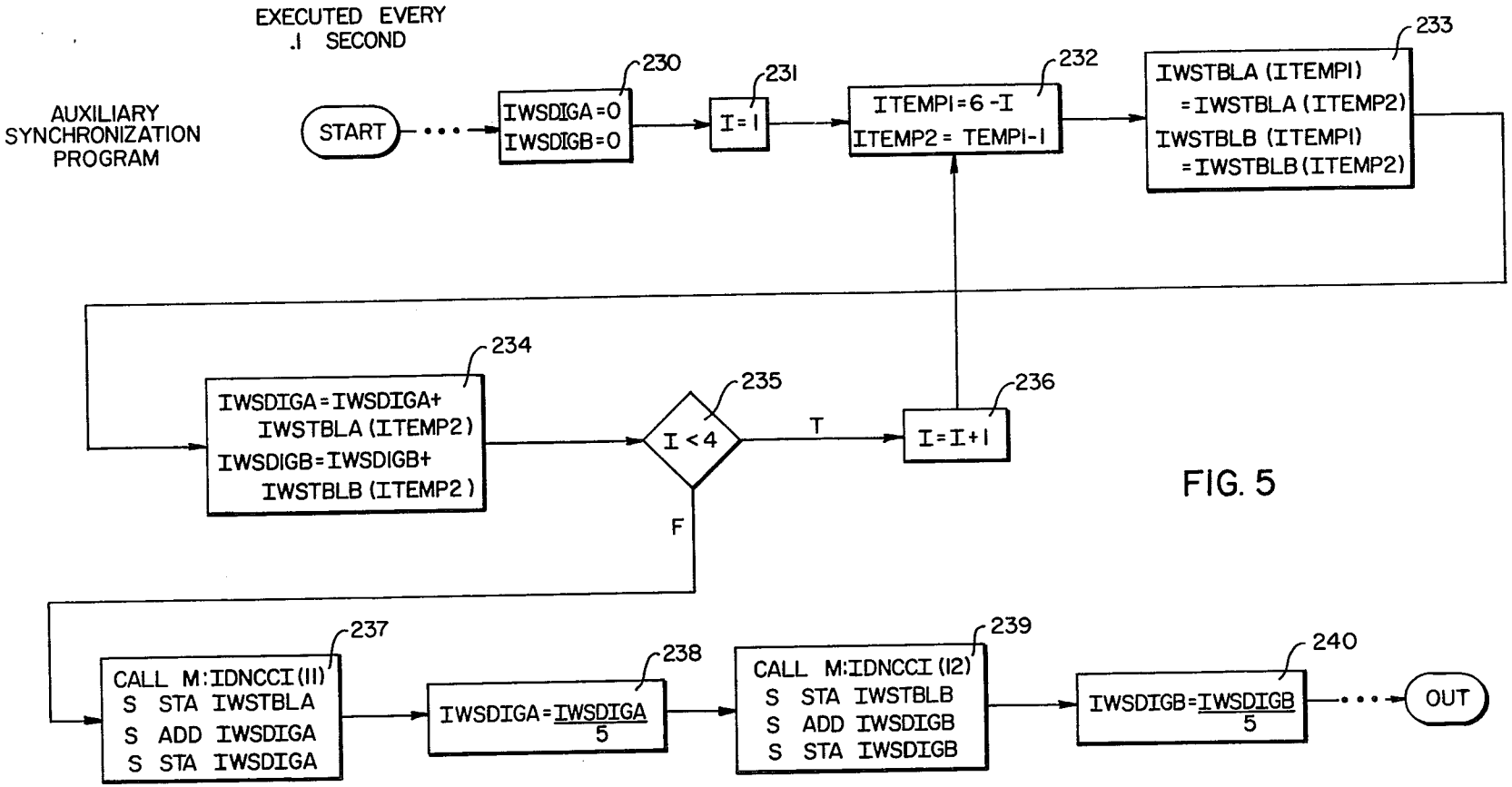
FIGS. 5, 6, 7A through 7D and 8 are Fortran flowcharts of the programs for performing the speed monitoring functions of the digital computer in accordance with the present invention.

Referring to FIG. 5, instructions are incorporated within the auxiliary synchronization program 204 to perform the functions of reading, averaging and storing the speed channels 37A and 38A every 0.1 second in accordance with the instructions 230 through 240. In 230 through 236, a speed signal array (IWSTBLA) is generated for speed signals 37A and a speed signal array (IWSTBLB) is generated for speed signals 38A. Each array contains the most recent five readings of its corresponding speed signals and is updated with each 0.1 second periodic execution. In 237, speed signal 37A is read through the D/I system 40 and added to the four most recent speed signals of the array (IWSTBLA). A result of the addition (IWSDIGA) is averaged by dividing by 5 in 238. In 239, speed signal 38A is read through D/I system 40 and added to the four most recent speed signals of the array (IWSTBLB). A result of the addition (IWSDIGB) is averaged by dividing by 5 in 240.

Figure 6:
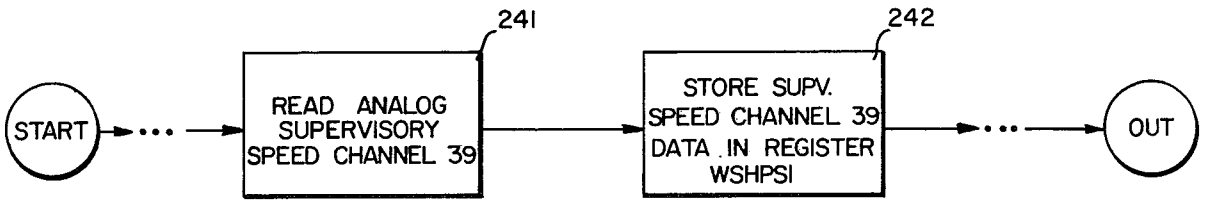

During an execution of the A/I scan program 206, the supervisory speed signal 39 is read and stored in accordance with the instructions 241 and 242 (FIG. 6).

Throughout the Fortran flowcharts (FIGS. 7A through 7D) of the control program 208, a flag will be set false prior to executing a decision block. Depending on the results of the decision block, the flag will either be set true or maintained false until the next periodic 1 second execution of the control program 208.

Within the control program 208, instructions are incorporated to perform the following functions. A low limit check override flag (LREFMIN) is set false and TEMP1 is set equal to a preselected low threshold constant in 243. The low limit check referred to here is similar to that described in FIG. 3 for the OPC function 120, in the functional blocks of 124 and 126. If the conditions, speed reference (REFDMD) is less than or equal to a predetermined low limit (WSREFMIN) normally set at 300 RPM, BR false which generally denotes speed control, and the speed signals 37A (WSDIGA), 38A (WSDIGB) and 39 (WSHPSI) are all less than a predetermined low threshold (TEMP1) are all true, then LREFMIN will be set true 245, otherwise it will remain false. The next decision block 246 checks if the speed system has been placed "out-of-service" (i.e. LSPDOUT = true) and if so sets the actual turbine speed measurement (WS) equal to zero 247. The next set of instructions 248, 250, 251 and 252 determine if speed channels 37A (WSDIGA) and 38A (WSDIGB) have departed from each other beyond a predetermined value (WSERRDIG) and sets the logical variable LTEMPS to its proper state. In the next instruction 253, all the flags LTEMPA, LTEMPB and LSHPSIOK pertaining to comparison checks of the supervisory speed channel 39 with 37A, 38A and a predetermined measurement range, respectively are set false. Next, 254 checks if the A/I system 42 is not operating (VIDAROS). If the A/I system is not operating, all comparisons using the supervisory speed channel 39 are skipped, and the instruction 263 is executed next. If the A/I system is operating, execution is continued to the next instruction 255.

The instructions 255, 256 and 256 determine if speed channels 37A and 39 have departed beyond a predetermined departure limit (WSERRSUP) and set flag LTEMPA to its respective state. Instructions 258, 259 and 260 determine if speed channels 38A and 39 have departed beyond a predetermined departure limit (WSERRSUP) and set flag LTEMPB to its respective state. Instruction 261 determines if the supervisory signal 39 is not within a predetermined measurement range as defined by the limits WSMIN and WSMAX or if signal 39 has departed from both signal 37A ($\overline{\text{LTEMPA}}$) and signal 38A ($\overline{\text{LTEMPB}}$). If any of the conditions are true, LSHPSIOK remains false, otherwise LSHPIOK is set true by instruction 262.

Following next, functional blocks 263 through 265, determine if speed channel 37A has departed in value from both speed channels 38A and 39 beyond their respective departure limits or speed channel 37A has gone beyond its predetermined measurement limits as defined by WSMIN and WSMAX. If either of these logical conditions are true as determined by instruction 264, channel 37A is considered malfunctioning and logical variable LSDIGAOK is maintained false, otherwise LSDIGAOK is set true by instruction 265. Note, that if the low limit override flag (LREFMIN) is set, the low measurement limit check is bypassed in 261 and 264. Identical instructions 266, 267 and 268 are executed next to determine if speed channel 38A is malfunctioning and accordingly logical variable LSDIGBOK is set to its respective state. Instructions 270, 271 and 272 determine if both speed channels 37A and 38A have malfunctioned and set the flag LSABFAIL to its proper state.

The next set of instructions 273, 274 and 275 set flag LSPDMON true if any one of the speed channels 37A, 38A or 39 is determined malfunctioning. Instructions 276 through 281 determine if at least two out of the three speed channels 37A, 38A and 39 have malfunctioned and set the flag LSPDOUT to its respective state. If at least two channels have malfunctioned as determined by 280, the runlogic flag is set 281 and the remainder of the speed monitoring program is bypassed. If the decision of 280 is false, the speed monitor program execution continues.

The next set of instructions 282 through 286 determine if the actual speed measurement (WS) should be transferred to a new speed channel. The past state (LSSELFFX) of the speed channel selection flip-flop is made equal to the present state (LSSELFF) in 282. Instructions 283, 284, 285 and 286 update the state of the speed channel selection flip-flop if either speed channel 37A or 38A is malfunctioning. Otherwise, the logical state of LSSELFF will not be updated. Note that even if LSSELFF is updated 284 or 286, the logical variable LSSELFF may not change state. As an example, suppose that speed channel 38A is being used as the actual speed measurement (WS) and accordingly LSSELFF is false, then should channel 37A malfunction, instruction 284 will update LSSELFF false which was its state before updating. A transfer decision is made in 287 by exclusive "or"ing the past (LSSELFFX) and present (LSSELFF) states of the speed channel selection flip-flop and the result is tested in 288. If the results of the exclusive "or" function are true wherein a difference in past and present states of the flip-flop are detected, then the next block 290 must be executed such to perform a transfer. Otherwise, no transfer is needed and the speed channel as indicated by the logical state of the speed channel selection flip-flop (LSSELFF) will be used as the actual turbine speed measurement (WS) as performed by instructions 299, 300 and 301.

Following in instructions 290, 291 and 292, the speed channel as determined by the state of LSSELFF is stored in a temporary register TEMP. If under speed control as determined by 293, the instruction 294 is executed to perform a bumpless transfer to the newly selected speed channel by calculating the error between the present WS and TEMP and subtracting the error from the old speed reference set point to calculate a new speed reference set point (REFDMD). In essence, this operation maintains the speed control error constant as a transfer of the actual speed measurement from the speed channel to another is executed, therefore creating no disturbance in the operation of the turbine. If under load control as determined by 293, an error is calculated between the fixed inlet speed value (WR) and the new speed channel value (TEMP) in 295. This error is used in 296 to calculate a new load demand regulation which is used to compensate the load reference set point in 297. The operator's demand (ODMD) is set equal to the compensated reference demand (REFDMD) in 298. The actual turbine speed measurement, WS, is then made equal to the newly selected speed channel in instructions 299, 300 and 301 as determined by the state of LSSELFF.

Figure 8:
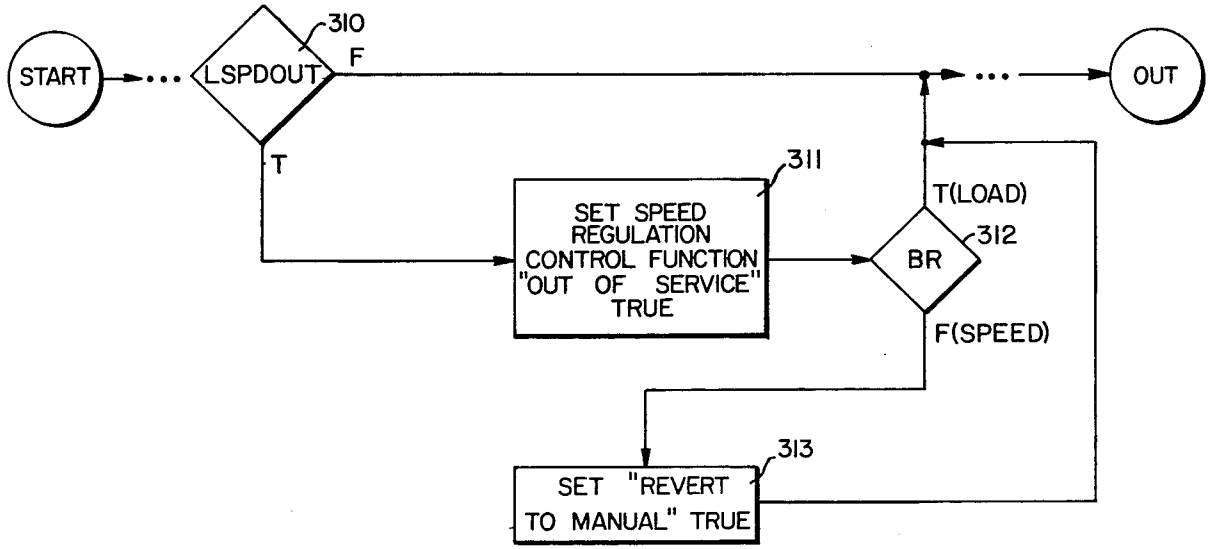
Figure 7A:
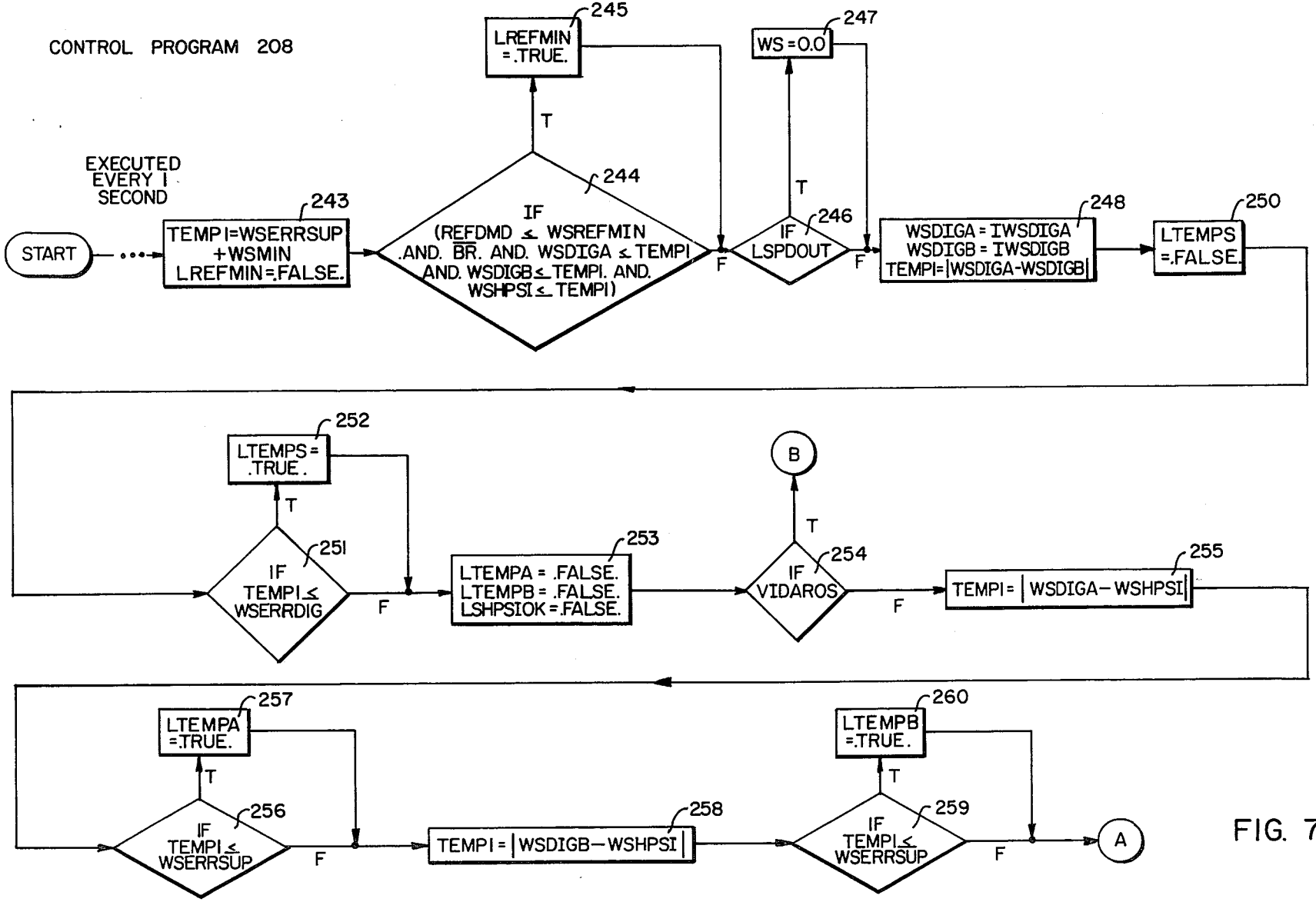
Figure 7B:
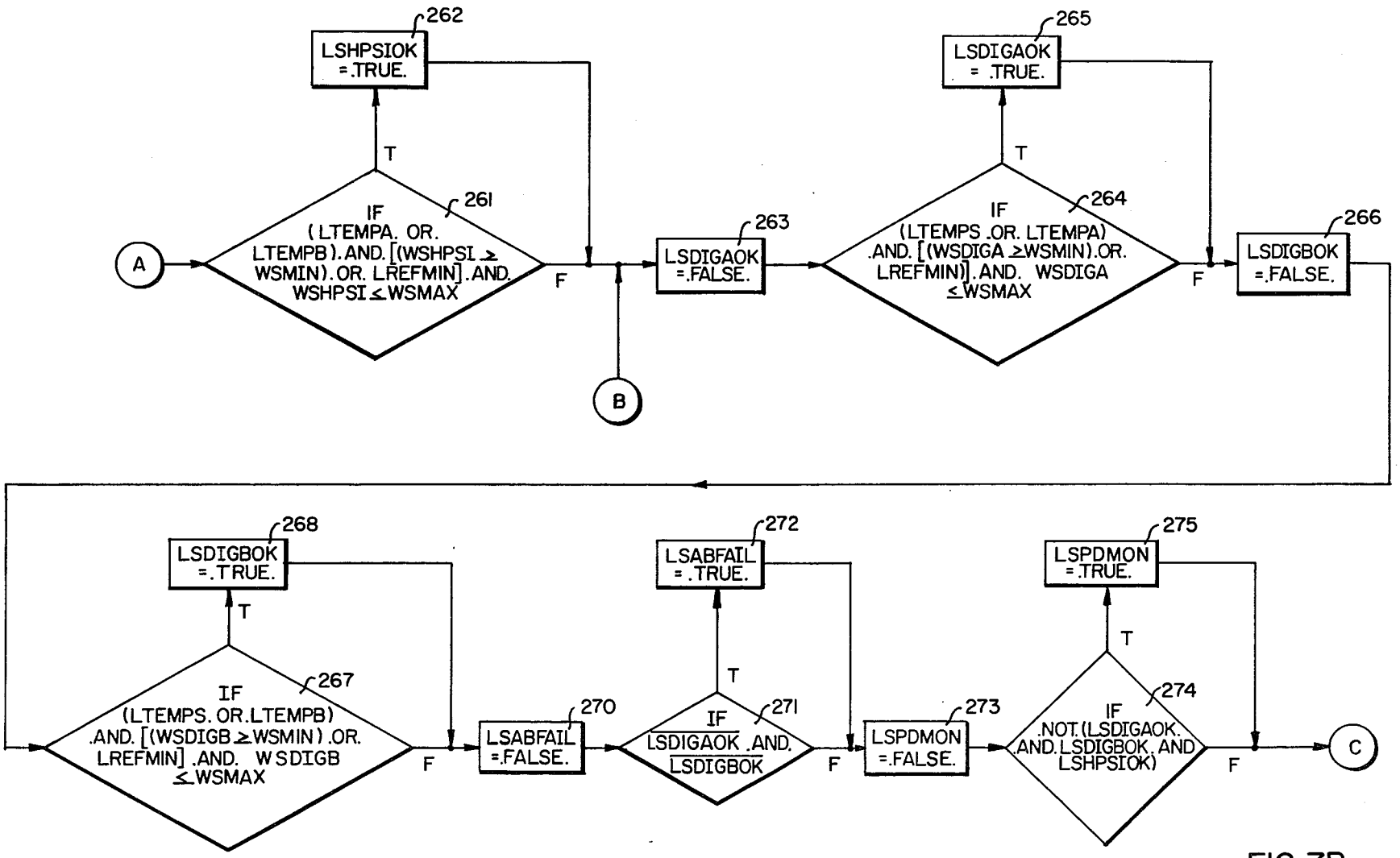
Figure 7C:
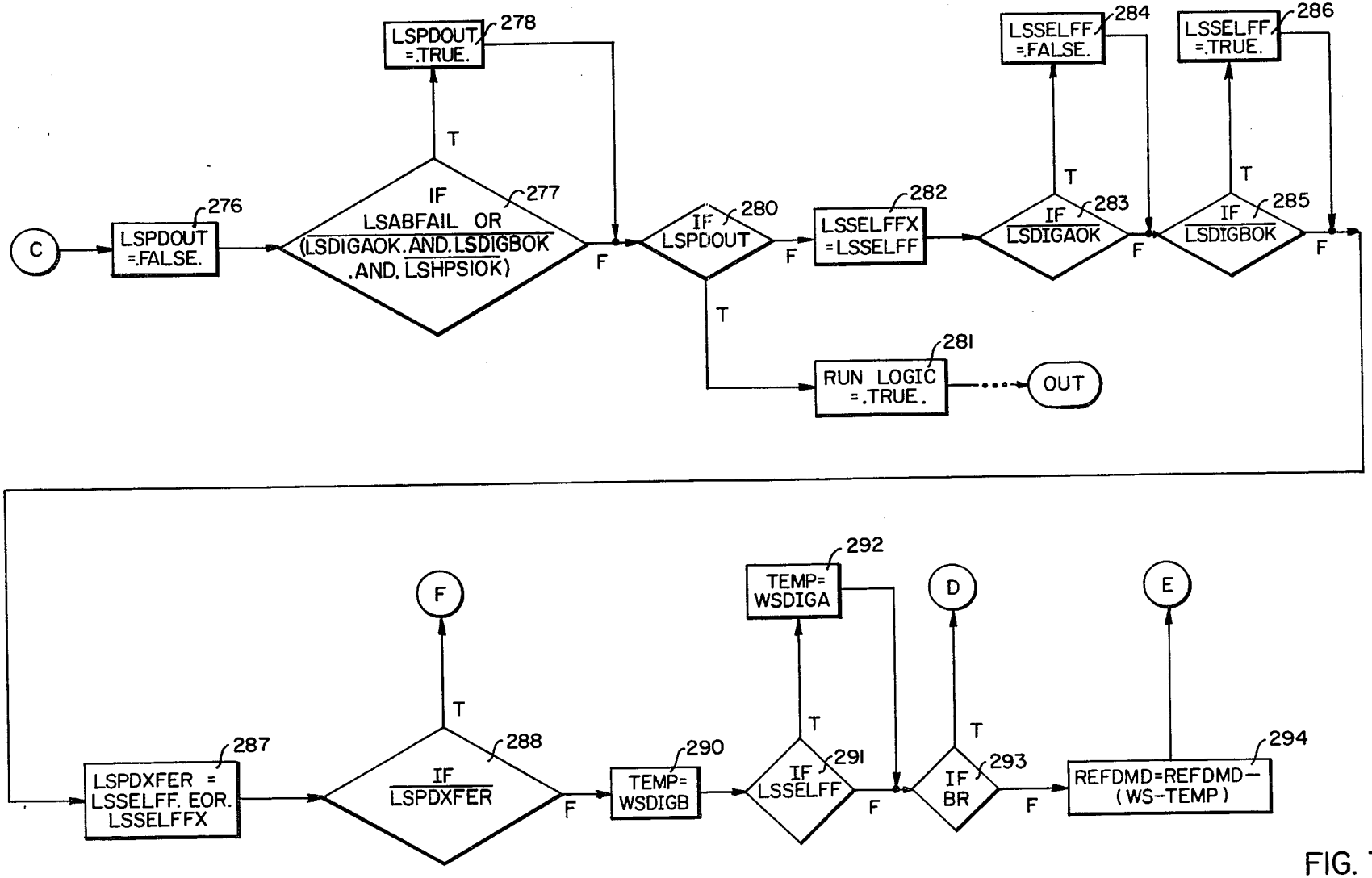
Figure 7D:
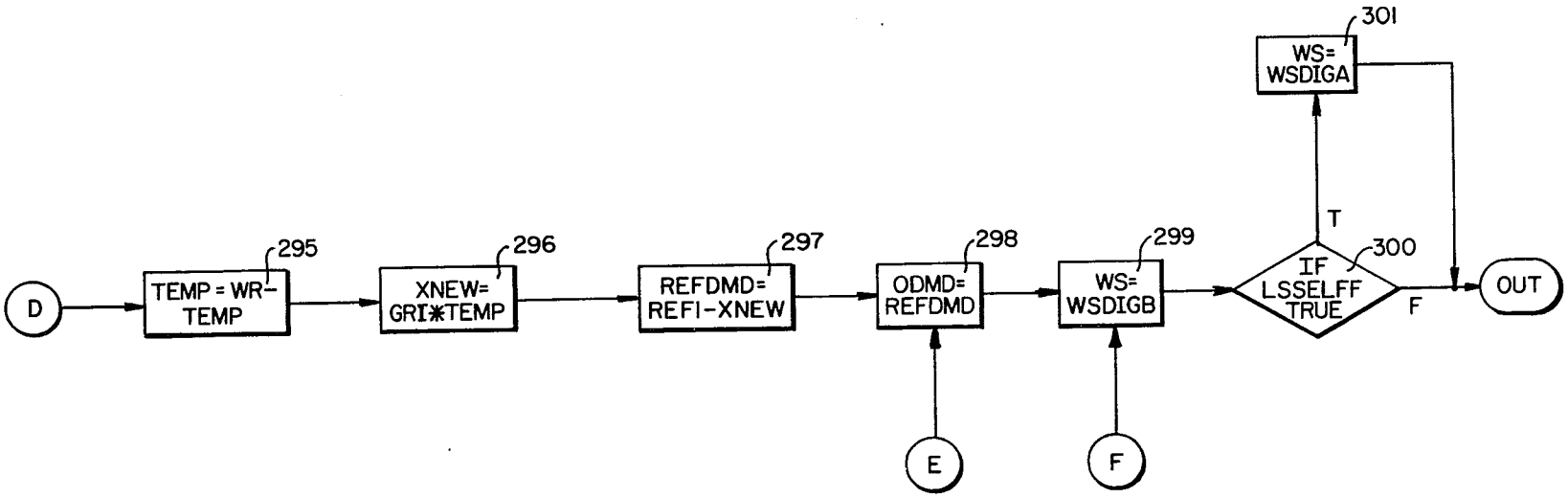

If the runlogic flag 212 is set, then the LOGIC program 210 will be executed. As shown in FIG. 8, within the LOGIC program 210 there is a portion of the speed monitoring function. If at least two out of three speed channels have malfunctioned (i.e. LSPDOUT = true) as determined in decision block 310, the speed regulation control function will be disabled in 311. Speed or load control is determined by instruction 312. If under speed control, the digital computer 44 control will be transferred to the backup manual system 51 in 313. If under load control, the remainder of the logic program will be executed.

As an example of operation of the speed monitoring system of the digital computer 44 as shown in the Fortran flowcharts of FIGS. 5, 6, 7A through 7D and 8, let us assume that speed channel 37A has been initially selected as the actual turbine speed measurement (WS) with all speed channels 37A, 38A and 39 are functional and the turbine speed is approximately 2000 RPM. Assume now that speed channel 37A malfunctions by departing from the other speed channels 38A and 39. The auxiliary synchronization program 204 of FIG. 5 will update the speed channels 37A and 38A every 0.1 second by reading, averaging and storing the speed signals in registers IWSDIGA and IWSDIGB, respectively. The analog scan program 206 of FIG. 6 will update the speed channel 39 every 0.5 second and store the speed signal in register WSHPSI. The control program 208 of FIGS. 7A through 7D as executed every one second will determine the malfunction of 37A according to the following operation.

The register TEMP1 is set equal to the low threshold constants (WSERRSUP and WSMIN) in 243. The override flag LREFMIN will be maintained false through instructions 243 and 244 since the reference demand (REFDMD) is greater than 300 RPM (WSREFMIN). Since the speed system is operating (i.e. LSPDOUT = true), instruction 247 is bypassed. In 248, the averaged values of speed channels 37A and 38A are put in registers WSDIGA and WSDIGB, respectively. Instructions 248, 250 and 251 set LTEMPS false by determining that 37A and 38A do not agree in value. The instructions of 253 set all flags LTEMPA, LTEMPB AND LSHPIOK false. Assuming that the A/I sybsystem 42 is operational, the execution is continued at 255. Instructions 255 and 256 set LTEMPA false by determining that 37A and 39 do not agree in value. Instructions 258, 259 and 260 set LTEMPB true by determining that 38A and 39 do agree in value. The flag LSHPIOK is set true by instructions 261 and 262 by determining that 39 agrees with 38A in value and is within its defined measurement limits. Instructions 263 and 264 set LSDIGAOK false by determining that both LTEMPA and LTEMPS are false. The flag LSDIGBOK is set true through instructions 266, 267 and 268 since LTEMPB is true and channel 38A is within its defined measurement limits. The flag LSABFAIL is set false by instructions 270 and 271 indicating that both channels 37A and 38A have not failed. Instructions 273, 274 and 275 set flag LSPDMON true indicating at least one channel has malfunctioned by determining that LSDIGAOK is false. Since only one channel 37A has malfunctioned, flag LSPDOUT is maintained false through instructions 276 and 277 and execution is continued at 282.

Instruction 282 sets the past state LSSELFFX equal to the present state LSSELFF which is true because 37A is the selected speed channel. Detecting a malfunction in 37A in 283 branches the execution to 284 which updates LSSELFF false. Since channel 38A is functioning, execution continues through 285 to 287. Instruction 287 detects a change in state of LSSELFF from the previous execution to the present execution of the control program 208 and sets LSPDXFER true indicating that a transfer between speed channels is needed. Instruction 288 detects the transfer request and branches the program execution to 290. Instructions 290 and 291 transfer the present speed channel 38A reading to register TEMP as determined by LSSELFF being presently false. Being in speed control (BR = false) branches the program execution to 294. Instruction 294 algebraically subtracts the present reading of speed channel 38A (TEMP) from the previous reading of the selected speed channel 37A (WS) and algebraically subtracts the resulting difference from the previous reference demand value to calculate a new reference demand value (REFDMD). The instruction 294 is performed to maintain the speed control error constant when transferring the value of WS from the value of speed channel 37A to the value of speed channel 38A as performed by instructions 299 and 300. Instruction 298 sets the operator's demand (ODMD) equal to the newly calculated speed reference demand (REFDMD).

Assuming that the state of the speed monitoring system remained the same as it was left in the previous example and that speed channel 37A returned within the departure limits of the other two channels 38A and 39, the next execution of the control program 28 will proceed in accordance with the following operation. Instruction 252 will set LTEMPS true indicating speed channels 37A and 38A again agree in value. Continuing, instruction 257 will set LTEMPA true indicating speed channels 37A and 39 also agree in value. Next, the flag LSDIGAOK is set true indicating that speed channel 37A is again functional. The single speed channel failure flag LSPDMON will be set false by 273 and 274. Program execution continues to instruction 282. Since LSDIGAOK is true, instructions 282, 283, 285 and 287 are executed without providing the transfer request being LSPDXFER equals true. Note that the past logic signal LSSELFFX and present logic signal LSSELFF remain the same. Since no transfer request is detected in 288, program execution continues by selecting the same speed channel 38A as the actual speed measurement (WS) in instructions 299 and 300. Here again, the operation presents the principle of selecting a speed channel without preference to be used as the actual speed measurement (WS) in accordance with the present embodiment.

As an example of at least two speed channels malfunctioning, let us assume that all three speed channels 37A, 38A and 39 have departed in value beyond their respective departure limits with either 37A or 38A having been selected as the actual speed measurement (WS). Again assume that speed is being controlled at 2000 RPM. Then, during execution of the control program 208, the flag LTEMPS will be set false by instructions 250 and 251 indicating 37A does not agree in value with 38A. Also, LTEMPA will be set false by instructions 253, 255 and 256 indicating 37A is departing in value from 39 and LTEMPB will be set false by instructions 253, 258 and 259 indicating 38A is departing in value from 39. The flag LSHPSIOK will be set false by instructions 253 and 261 indicating 39 has departed in value from both 37A and 38A. Continuing further, flags LSDIGAOK and LSDIGBOK will be set false by instructions 263, 264, 266 and 267 indicating that both 37A and 38A have malfunctioned which also permits flag LSABFAIL to be set true by instructions 270, 271 and 272. The flag LSPDMON will also be set true in 275 as a result of the decision 274. Instructions 276, 277 and 278 set LSPDOUT true as a result of all channels 37A, 38A and 39 departing from each other in value. With LSPDOUT true, the runlogic flag is set by instruction 281 and the remainder of the speed monitoring portion of the control program 208 is bypassed. Consequently, the next 0.1 second periodic interrogation of the runlogic flag 212 will result in the execution of the logic program 210. Within the logic program 210 is the decision instruction 310. If LSPDOUT is true, the speed regulation control function is disabled in 311. Since BR is open (speed control), then instruction 313 is executed which sets a "revert-to-manual" flag true. In the next periodic execution of the control program 208, the instruction 246 upon detecting LSPDOUT true will branch to 247 which sets the actual speed measurement (WS) to zero. The program continues again to instruction 281 where runlogic is set true again and the remainder of the speed monitoring portion of the control program 208 is bypassed.

In summary, the invention as described in the above specification overcomes the reliability and availability limitations of previous systems presently in use by providing three speed channels of information to both the digital computer 44 through 37A, 38A and 39 and the OPC 46 through 37B, 38B and 39. Two of the speed channels 37A and B and 38A and B are produced by identical means 36A and 36B, respectively whereby making available two essentially equal speed channels in each controller 44 and 46.

Further, the disadvantages of the priority structure in the selection preference as performed in the previous systems are overcome in the present invention. One of the identical speed channels 37A or 38A in the digital computer 44 is selected without preference as the actual turbine speed measurement to be used in the control of turbine speed and load. Only if a malfunction is detected in that speed channel 37A or 38A being utilized as the actual turbine speed measurement will a new channel be selected. In addition, during speed control the transfer between speed channels 37A and 38A will not affect the turbine operation because the speed control error is maintained constant through the transfer.

The present invention also minimizes the possibility of causing a false OPC action due to a single speed channel malfunction as described in one previous system by providing the OPC 46 with three speed channels of information 37B, 38B and 39. The speed monitoring system 120 of the OPC 46 can detect a malfunction of a single speed channel and if necessary, can initiate a transfer between identical speed channels well in advance of an OPC action.

Additionally, the present invention provides for detection of a single channel malfunction and corresponding selection transfer operation to occur in the digital computer 44 without affecting the operation of the OPC 46 and also detection of a single channel malfunction and corresponding selection transfer operation to occur in the OPC 46 without disturbing the digital computer 44. In addition, the OPC 46 can be disabled upon detection of any two of its three speed channels 37B, 38B and 39 malfunctioning without affecting the operation of the turbine or the speed or load control of the digital computer 44. The speed monitoring system of the digital computer 44 has provisions to revert to manual control under turbine start-up conditions upon detection of any two of its three speed channels 37A, 38A and 39 malfunctioning without affecting the operation of the turbine or the OPC 46.

It is understood that the various groupings of components described herein may differ. Such groupings of components of FIG. 3, for example, is made merely to facilitate a better understanding and description of the invention. Further, the foregoing Fortran flow charts in FIGS. 5, 6, 7A through 7D and 8 and description thereof have been presented only to illustrate an actual reduction to practice of the invention. The above embodiment refers to a digital computer based system to store and execute the aforementioned Fortran programs for control of turbine speed and load; however, it is understood that other digital processor systems, for example a microprocessor system, can similarly perform the same functions. Accordingly, it is desired that the invention not be limited by the embodiment described but rather that it be accorded an interpretation consistent with the scope and its broad principles.

AUXILIARY SYNCHRONIZER PROGRAM 204 LISTING

```
S      DAT        X'34FF'
S      DAT        X'0005'
S      STA        LSWDSYAD
S      STZ        MSWDSYAD
S      STZ        04
S      LDA        IZ:LAST
S      SDA        MSWDSYAD
S      NJP        )25
S      LDA        LSWDSYAD
S      DAT        X'34FE'
S      DAT        X'0105'
S      JMP        )30
S25    LDA        IDISFLSH
S      EOR        KXAAAA
S      STA        IDISFLSH
S      DAT        X'34FE'
S      DAT        X'0005'
C
C              READ THE TWO DIGITAL SPEED CHANNELS, AVERAGE THE LAST FIVE
C              READINGS FOR USE BY THE CONTROL PROGRAMS.
C
30     CONTINUE
       IWSDIGA = 0
       IWSDIGB = 0
       DO 50  I = 1,4
       ITEMP1 = 6 - I
       ITEMP2 = ITEMP1 - 1
       IWSTBLA(ITEMP1) = IWSTBLA(ITEMP2)
       IWSTBLB(ITEMP1) = IWSTBLB(ITEMP2)
       IWSDIGA = IWSDIGA + IWSTBLA(ITEMP1)
50     IWSDIGB = IWSDIGB + IWSTBLB(ITEMP1)
       CALL M:IDNCCI(11)
S      STA        IWSTBLA
S      ADD        IWSDIGA
S      STA        IWSDIGA
       IWSDIGA = IWSDIGA/5
       CALL M:IDNCCI(12)
S      STA        IWSTBLB
S      ADD        IWSDIGB
S      STA        IWSDIGB
       IWSDIGB = IWSDIGB/5
C
```

A/I SCAN
PROGRAM 206 LISTING

```
C                ANALOG SCAN TASK
C
C*********************************************************************
C
C                    ANALOG INPUT SCAN TASK
C
C*********************************************************************
C
C
      DIMENSION
     1    NSTART(2)      ,NSTOP(2)
      DATA
     1    KX8001                                                      /
     1     $6001                                                      /
C
C                IASCNRQ
C                1,6,11 ETC :THROTTLE VALVE POSITIONS, OPC SPEED, PLANT
C                            LOAD RATE LIMIT, THROTTLE VALVE DEMANDS, AND
C                            ATC 5 SEC POINTS
C                2,7,12 ETC :ATC 5 SEC POINTS
C                3,13,23 ETC:HALF THE ATC 10 SEC POINTS
C                4,9,14 ETC :GROUPS OF ATC 60 SEC POINTS
C                5,10,15 ETC:VALVE TEST SIGNALS, GOVERNOR VALVE SEQ A/O'S,
C                            AND GOVERNOR VALVE POSITIONS
C                8,18,28 ETC:REMAINING HALF OF THE ATC 10 SEC POINTS
C
C                NAIPTS(J) AND IAIBFIDX(J)
C                J = 1       :THROTTLE VALVE DEMANDS AND 1 SEC CONTROL PNTS
C                J = 2       :1 SEC CONTROL POINTS ONLY
C                J = 3       :VALVE TEST SIGNALS, GOVERNOR VALVE SEQ A/O'S,
C                             AND GOVERNOR VALVE POSITIONS
C                J = 4       :THROTTLE VALVE POSITIONS, OPC SPEED, PLANT
C                             LOAD RATE LIMIT, THROTTLE VALVE DEMANDS, AND
C                             ATC 5 SEC POINTS
C                J = 5       :ATC 5 SEC POINTS
C                J = 6       :HALF THE ATC 10 SEC POINTS
C                J = 7       :REMAINING HALF OF THE ATC 10 SEC POINTS
C                J = 8-25    :GROUPS OF ATC 60 SEC POINTS
C
100   CONTINUE
C
C                CHECK THE KEYBOARD ENTERED VARIABLE FOR A/I IN/OUT OF SERV
C                IF THE OPERATOR HAS REQUESTED THAT THE A/I SYSTEM IS TO BE
C                PUT BACK IN SERVICE, ATTEMPT TO RESTORE THE SYSTEM TO
C                SERVICE
C
      IF( RLT:(RAIOSERV,.50) .AND. RGT:(RTRACK,.50) )GO TO 180
      IF( VIDAROS ) RAIOSERV = 1.0
      GO TO 200
180   VIDAROS = .FALSE.
      CALL SPANADJ(KX8001)
200   RTRACK = RAIOSERV
C
C                SCAN THE ONCE PER SEC CONTROL ANALOG INPUTS AND, IF REQ'D,
C                THROTTLE VALVE DEMAND SIGNALS FOR ACCURATE TRACKING
C                ON THROTTLE VALVE CONTROL IN THE MANUAL MODE
C
      J = 2
      IF( (.NOT. TRCOM).AND. TM )J = 1
      NASCNCVT = NAIPTS(J)
      IASCNSTR= IAIBFIDX(J)
      CALL M:ANI(KX8001,NASCNCVT,IAICW(IASCNSTR),IAIBV(IASCNSTR),
     $           IFLGWRD)
C
C                REQUEST AN ANALOG INPUT SYSTEM HARDWARE CALIBRATION
C
      CALL SPANADJ(1)
C
C                CHECK THE STATUS OF THE ANALOG INPUT SYSTEM
C
      IF( IFLGWRD .GT. 2 )VIDAROS = .TRUE.
      IF( VIDAROSX .EOR. VIDAROS )CALL M:IN(NTLOGIC)
      VIDAROSX = VIDAROS
C
C                RID THE CONTROL A/I CONVERSION TASK
C
      CALL M:IN(NTANCVTB)
C
C                INCREMENT THE ANALOG SCAN COUNTER THAT SELECTS THE GROUP
C                OF POINTS TO BE SCANNED DURING THE REMAINING .5 SEC.
C                THE SCAN MUST BE COMPLETED IN .5 SEC.  HENCE THE MAXIMUM
C                NUMBER OF POINTS DEPENDS ON WHETHER THE SYSTEM IS 50 OR
C                60 HZ
C
      IASCNRQ = IASCNRQ + 1
```

```
      IF(IASCNRQ  .GE. 61 )IASCNRQ = 1
C
C            CALCULATE A COUNTER (ITEMP) THAT VARIES FROM 1 THRU 10
C
      ITEMP = IASCNRQ - ( (IASCNRQ-1)/10 ) *10
      GO TO (1200,1300,1400,1500,1100,1200,1300,1420,1500,1100), ITEMP
C
C             SCAN THE VALUE TEST A/D, VALVE TEST SIGNAL TO VALVES,
C             GOV VALVE SEQUENTIAL A/D'S, AND GOV VALVE POSITIONS
C
1100  M = IAIBFIDX(3)
      CALL M:ANI(KX8001,NAIPTS(3),IAICW(M),IAIBV(M),IFLGWRD)
      IF( IFLGWRD .GT. 2 .OR. VIDAROS )GO TO 2500
      GVSCAN = .TRUE.
      NSTART(1) = M
      NSTOP(1)  = NSTART(1) + 2 + (NOVLV-1)
      NSTART(2) = M+10
      NSTOP(2)  = NSTART(2) + (NOVLV-1)
      GO TO 1225
C
C             SCAN THE THROTTLE VALVE POSITIONS, OPC SPEED, PLANT LOAD
C             RATE LIMIT, THROTTLE VALVE DEMANDS, AND SOME ATC 5 SEC PTS
C
1200  M = IAIBFIDX(4)
      MAIPTIDX = IAIBFIDX(4) +9
      NAIPTSCN = NAIPTS(4) - 9
      CALL M:ANI(KX8001,NAIPTS(4),IAICW(M),IAIBV(M),IFLGWRD)
      IF( IFLGWRD .GT. 2 .OR. VIDAROS )GO TO 2500
      TVSCAN = .TRUE.
      NSTART(1) = M
      NSTOP(1)  = NSTART(1) + (NTV-1)
      NSTART(2) = M+4
      NSTOP(2)  = NSTART(2) + 4
C
C             PERFORM HI-LO CHECKS ON THE A/I BIT PATTERN. A FULL SCALE
C             POSITIVE READING HAS A BIT PATTERN OF X'1000'. A FULL
C             SCALE NEGATIVE READING HAS A BIT PATTERN OF X'F000'. ALL
C             THESE A/I'S ARE POSITIVE.
C
1225  DO 1250 I = 1,2
      NMIN = NSTART(I)
      NMAX = NSTOP(I)
      DO 1250 L = NMIN, NMAX
      ITEMP1 = IAIBV(L)
      IF( ITEMP1 .GT. 0 )GO TO 1240
      ITEMP1 = 0
      GO TO 1245
1240  IF( ITEMP1 .GT. 4096 )ITEMP1 = 4096
1245  ITEMP2 = L - 15
1250  IAICVT(ITEMP2) = ITEMP1
      GO TO 2500
C
C
C             SCAN THE ATC 5 SEC A/I'S
C
1300  J = 5
      GO TO 2200
C
C             SCAN THE FIRST HALF OF THE ATC 10 SEC A/I'S
C
1400  J = 6
      GO TO 2200
C
C             SCAN THE SECOND HALF OF THE ATC 10 SEC A/I'S
C
1420  J = 7
      GO TO 2200
C
C             SCAN THE ATC 60 SEC A/I'S
C             NOTE THAT THE FOLLOWING EXPRESSION ASSUMES THAT 60 SEC
C             PNTS ARE SCANNED AT IASCNRQ = 4,9,ETC.
C
1500  J = 7 + ( (IASCNRQ+1) / 5 )
C
C
2200  IF( .NOT. ATSSCAN )GO TO 2500
      NAIPTSCN = NAIPTS(J)
      MAIPTIDX = IAIBFIDX(J)
      CALL M:ANI(KX8001,NAIPTSCN,IAICW(MAIPTIDX),IAIBV(MAIPTIDX),
     $           IFLGWRD)
C
C             INDICATE THAT THE REQUESTED SCAN HAS BEEN COMPLETED
C
2500  IASCNCMP = IASCNRQ
C
```

```
171   C              CHECK THE STATUS OF THE ANALOG INPUT SYSTEM
172   C
173          IF( TFLGWRD .GT. 2 ) VIDAROS = .TRUE.
174          IF( VIDAROSX .EOR. VIDAROS )CALL MIIN(NTLOGIC)
175          VIDAROSX = VIDAROS
176          CALL EXIT
177          GO TO 100
178          END
EXIT

1     C              ANALOG CONVERSION TASK
2     C
3     C*****************************************************************
4     C
5     C                    ANALOG INPUT CONVERSION TASK FOR
6     C                    BASE CONTROL ANALOG POINTS
7     C
8     C*****************************************************************
9     C
10           DIMENSION
11          1    IFAILPAT(3)    ,IAIBVIDX(7)    ,IAICVIDX(7)
12    C
13           LOGICAL
14          1    LTMPFAIL
15    C
16           DATA
17          1    KXFFFC         ,IFAILPAT(1)    ,IFAILPAT(2)    ,IFAILPAT(3)    /
18          1     $FFFC         ,$0000          ,$0001          ,$0003          /
19           DATA
20          1    KX0002                                                         /
21          1     $0002                                                         /
22           DATA IAIBVIDX /
23          1        7,    8,    9,   10,   11,   39,   38                      /
24           DATA IAICVIDX /
25          1        1,    2,    3,    4,    5,   13,   14                      /
26    C
27    C              CONVERT THE VALVE DEMAND SIGNALS. IF THE THROTTLE VALVE
28    C              DEMANDS WERE SCANNED (IASCNSTR = 1) THEY ARE CONVERTED
29    C              ALONG WITH THE GOVERNOR VALVE DEMANDS. THE DEMAND SIGNALS
30    C              SHOULD RANGE FROM 0.0 TO 10.0 VOLTS (0 TO 4096)
31    C              IF THE A/I SYSTEM HAS FAILED, DON'T PROCESS THE BINARY
32    C              VALUE (IAIBV(XXX)) FROM THE A/I SYSTEM
33    C
34    100    CONTINUE
35           IF( VIDAROS ) GO TO 575
36           DO 500 I =IASCNSTR,6
37           ITEMP1 = IAIBV(I)
38           IF( ITEMP1 .GT. 0 ) GO TO 450
39           ITEMP1 = 0
40           GO TO 480
41    450    IF( ITEMP1 .LT. 4096 ) GO TO 480
42           ITEMP1 = 4096
43    480    ITEMP2 = 24+I
44    500    IAICVT(ITEMP2) = ITEMP1
45    575    CONTINUE
46           IF( VIDAROS )GO TO 1500
47    C
48    C              CONVERT THE BINARY VALUE (IAIBV(XXX)) FROM THE A/I SYSTEM
49    C              INTO ENGINEERING UNITS. CHECK AGAINST HIGH AND LOW LIMITS.
50    C              IF THE VALUE EXCEEDS A LIMIT, REPLACE THE VALUE WITH THAT
51    C              LIMIT AND SET BIT 0 AND 1 IN THE SECOND WORD OF THE VALUE
52    C              ACCORDING TO THE FOLLOWING FAILURE CONDITION
53    C
54    C              REL BITS            STATUS OF VARIABLE
55    C
56    C               00                 OK
57    C               01                 VALUE EXCEEDS THE LOW LIMIT
58    C               11                 VALUE EXCEEDS THE HIGH LIMIT
59    C
60           DO 1000 I =1,7
61           LTMPFAIL = .FALSE.
62           IFAILSEL = 1
63           ITMPIDX = IAIBVIDX(I)
64           AITMP = IAIBV(ITMPIDX)
65           ITMPIDX = IAICVIDX(I)
66           AITMP = SLOPE(ITMPIDX) * AITMP + BINT(ITMPIDX)
67           IF( RGT:(AITMP,AILL(ITMPIDX) ) ) GO TO 600
68           AITMP = AILL(ITMPIDX)
69           LTMPFAIL = .TRUE.
70           IFAILSEL = 2
71           GO TO 700
72    600    IF( RLT:(AITMP,AIHL(ITMPIDX) ) ) GO TO 700
73           AITMP = AIHL(ITMPIDX)
74           LTMPFAIL = .TRUE.
75           IFAILSEL = 3
76    700    CONTINUE
```

```
C
C                COMPARE THE MEGAWATT TRANSDUCER SIGNAL WITH THE DEMAND
C                SIGNAL (REF1) TO THE MEGAWATT CONTROLLER, IF IT EXCEEDS
C                A TOLERANCE, CONSIDER THE SIGNAL TO HAVE FAILED.
C
        IF( ITMPIDX .NE. 5 ) GO TO 800
        IF( .NOT. BR .OR. LTMPFAIL )GO TO 760
        RTEMP = 1.0
        IF( MWI .OR. IPI .OR. LPCORR ) GO TO 750
        IF( (.NOT. TPXDOK) .OR. RLT:(PO,POMIN) )GO TO 760
        RTEMP = PO/POREF
750     RTEMP = ABS( RTEMP*REF1-AITMP)
        IF( RLE:(RTEMP,AIDBMW) )GO TO 760
        LTMPFAIL = .TRUE.
        IFAILSEL = 3
760     IF( .NOT.(AIFAILMW .EOR. LTMPFAIL) ) GO TO 800
        RUNLOGIC = .TRUE.
        CALL M:IN(NTLOGIC)
        AIFAILMW = LTMPFAIL
C
C                CLEAR THE RELIABILITY BIT FOR ALL CONVERTED VALUES
C
800     CONTINUE
S       LDA          AITMP+1
S       AND          KXFFFC
S       STA          AITMP+1
C
C                SET THE RELIABILITY BIT IF THE SIGNAL HAS FAILED
C
        IF( .NOT. LTMPFAIL )GO TO 820
        ITEMP1 = IFAILPAT(IFAILSEL)
S       LDA          ITEMP1
S       EOR          AITMP+1
S       STA          AITMP+1
820     RAICVT(ITMPIDX) = AITMP
        IF( ITMPIDX .EQ. 4 ) TPXDOK = .NOT. LTMPFAIL
1000    CONTINUE
        GO TO 2000
C
C                THE A/I SYSTEM HAS FAILED.  SET THE RELIABILITY BITS
C                1 AND 0 IN THE SECOND WORD TO 10.  DO NOT UPDATE THE
C                CONVERTED VALUE.
C
1500    DO 1700 I =1,7
        ITMPIDX = IAICVIDX(I)
        AITMP = RAICVT(ITMPIDX)
S       LDA          AITMP+1
S       AND          KXFFFC
S       EOR          KX0002
S       STA          AITMP+1
1700    RAICVT(ITMPIDX) = AITMP
        TPXDOK = .FALSE.
C
C                INDICATE THAT THE ANALOG SCAN AND CONVERSION IS COMPLETE
C
2000    LAIFIN = .TRUE.
        CALL EXIT
        GO TO 100
        END
EXIT

1800    MANOTRAK = .FALSE.
        IF(.NOT. ASL) GO TO 1850
        TEMP=ITVAO-ITVMAN
        TEMP = ABS(TEMP)
        IF( RGE:(TEMP,TVMANDB) )GO TO 1825
        TEMP=ISVAO-IGVMAN
        TEMP = ABS(TEMP)
        IF( RLT:(TEMP,GVMANDB) )GO TO 1850
1825    MANOTRAK=.TRUE.
1850    CONTINUE
C
C*****************************************************************
C
C                SELECT SPEED PROGRAM
C
C*****************************************************************
C
        LTEMP1 = LSPDMON
        LTEMP2 = LSPDOUT
        TEMP1 = WSMIN + WSERRSUP
        LREFMIN = RLE:(REFDMD,WSREFMIN) .AND. .NOT. BR .AND.
       1  RLE:(WSDIGA,TEMP1).AND.RLE:(WSDIGB,TEMP1).AND.RLE:(WSHPSI,TEMP1)
        IF( LSPDOUT ) WS = 0.0
```

CONTROL PROGRAM 208 LISTING

```
      WSDIGA = IWSDIGA
      WSDIGB = IWSDIGB
      TEMP1 = ABS(WSDIGA - WSDIGB)
      LTEMPS = RLE:(TEMP1,WSERRDIG)
      LTEMPA = .FALSE.
      LTEMPB = .FALSE.
      LSHPSIOK = .FALSE.
      IF( VIDABOS )GO TO 2050
      TEMP1 = ABS( WSDIGA - WSHPSI )
      LTEMPA = RLE:(TEMP1,WSERRSUP)
      TEMP1 = ABS( WSDIGB - WSHPSI )
      LTEMPB = RLE:(TEMP1,WSERRSUP)
C             CHECK THE SUPERVISORY SPEED
      LSHPSIOK = (LTEMPA .OR. LTEMPB ) .AND. ( RGE:(WSHPSI,WSMIN) .OR.
     1    LREFMIN ) .AND. RLE:(WSHPSI,WSMAX)
C             CHECK THE DIGITAL SPEEDS
2050  LSDIGAOK = (LTEMPS .OR. LTEMPA ) .AND. ( RGE:(WSDIGA,WSMIN).OR.
     1    LREFMIN) .AND. RLE:(WSDIGA,WSMAX)
      LSDIGBOK = (LTEMPS .OR. LTEMPB ) .AND. ( RGE:(WSDIGB,WSMIN) .OR.
     1    LREFMIN) .AND. RLE:(WSDIGB,WSMAX)
C             ARE BOTH DIGITAL SPEEDS FAILED
      LSABFAIL = .NOT. LSDIGAOK .AND. .NOT. LSDIGBOK
C             HAS THE SUPERVISORY SPEED OR EITHER DIGITAL SPEED FAILED
      LSPDMON = .NOT. (LSDIGAOK .AND. LSDIGBOK .AND. LSHPSIOK )
C             HAVE 2 OF 3 SPEED SIGNALS FAILED
      LSPDOUT = LSABFAIL .OR. ( .NOT. LSHPSIOK .AND.
     1          .NOT. ( LSDIGAOK .AND. LSDIGBOK)        )
      IF( LSPDOUT )GO TO 2400
C             2 OR MORE SPEED SIGNALS ARE OK
      LSSELFFX = LSSELFF
C             IF DIGITAL SPEED 'A' FAILED AND DIGITAL SPEED 'B' IS OK,
C             SET THE SPEED SELECTION FLIP FLOP FALSE.
      IF( .NOT. LSDIGAOK ) LSSELFF = .FALSE.
C             IF DIGITAL SPEED 'B' FAILED AND DIGITAL SPEED 'A' IS OK,
C             SET THE SPEED SELECTION FLIP FLOP TRUE.
      IF( .NOT. LSDIGBOK ) LSSELFF = .TRUE.
C             IF THE SPEED SELECTION FLIP FLOP HAS CHANGED STATE, A
C             SMOOTH TRANSFER IS NEEDED.
      LSPDXFER = LSSELFF .EOR. LSSELFFX
C
2400  IF( (LSPDMON .EOR. LTEMP1) .OR. (LSPDOUT .EOR. LTEMP2) )
     1                                                RUNLOGIC = .TRUE.
      IF( .NOT. (SPI .AND. LSPDXFER) )GO TO 2490
      TEMP = WSDIGB
      IF( LSSELFF )TEMP = WSDIGA
      IF( BR ) GO TO 2420
      REFDMD = REFDMD - (WS - TEMP )
      GO TO 2480
2420  TEMP = WR - TEMP
      IF( RLT:(TEMP,0.0) )GO TO 2430
      TEMP = TEMP - SPDBMINS
      IF( RLE:(TEMP,0.0) )GO TO 2460
      XNEW = GR8 * TEMP
      IF( RGT:(XNEW,HLF) )XNEW = HLF
      GO TO 2465
2430  TEMP = SPDBPLUS + TEMP
      IF( RGT:(TEMP,0.0) )GO TO 2460
      XNEW = GR1 * TEMP
      GO TO 2465
2460  XNEW = 0.0
2465  REFDMD = REF1 - XNEW
2480  ODMD = REFDMD
      IF( RGT:(REFDMD,HLL) )HLL = REFDMD
      IF( RLT:(REFDMD,LLL) )LLL = REFDMD
2490  LOWFREQ = .FALSE.
      IF( LSPDOUT )GO TO 2500
      WS =WSDIGB
      IF( LSSELFF ) WS = WSDIGA
      TEMP1 = 100.0 * WS / WR
      LOWFREQ = BR .AND. RLE:(TEMP1,RLOWFREQ)
C
C*****************************************************************************
C
C                    SELECT OPERATING MODE
C
C*****************************************************************************
C
C
C             INITIALIZE THROTTLE PRESSURE PROTECTION CONTROLLER
C
2500  IF(FIXTPSP) GO TO 2525
      IF((.NOT. TPC) .OR. TM .OR. (.NOT. BR)) POSP = PO - MANDIFPO
      IF( .NOT. TPXDOK) POSP = 0.
2525  IF(BR) GO TO 5000
C
C---------------- SPEED CONTROL ----------------------------------------
```

```
449   C
450         REFLLIM=.FALSE.
451         REFHLIM=.FALSE.
452   C                    AUTO SYNC
453   C
454         IF(.NOT. AS) GO TO 3500
455         IF(ASINC) GO TO 3025
456         IF(.NOT. ASDEC) GO TO 11000
457         TEMP=-1.
458         GO TO 3050
459   3025  IF(ASDEC) GO TO 3075
460         TEMP=1.
461   3050  REFDMD=REFDMD+TEMP
462         ODMD=REFDMD
463   3075  ASINC=.FALSE.
464         ASDEC=.FALSE.
465         GO TO 11000
466   C
467   C                    ATC MODE

256         REF2=ODMD+X                                                0389
257         REF1 = REF2                                                0390
258         GO TO 475                                                  0391
259   470   REF1=REFDMD+X                                              0392
260         RESMW=TEMP/(GR3*REF1)                                      0393
261         REF2=RESMW*REF1                                            0394
262   475   LTEMP3=.TRUE.                                              0395
263   480   IPIPB=IPI                                                  0396
264         IPIX=IPI                                                   0397
265         AIFAILPX=AIFAILPI                                          0401
266         DOIMGLOG(10) = IPI
267         DOIMGLOG(11) = .NOT. IPI
268         COIMGLOG(06) = IPI
269         COIMGLOG(07) = IPI
270         DOIMGLOG(12) = AIFAILPI
271         COIMGLOG(08) = AIFAILPI
272   C                                                                0404
273   C                    SPEED IN/OUT LOGIC                          0405
274   C                                                                0406
275         SPTF = LSPDOUT
276         SPI=FF(SPIPB,SPTF,SPI)                                     0407
277         SPIPB=SPI
278         DOIMGLOG(13) = SPI
279         DOIMGLOG(14) = .NOT. SPI
280         COIMGLOG(09) = SPI
281         COIMGLOG(10) = SPI
282         IF(.NOT.BR) GO TO 492                                      0412
283         IF(.NOT.(SPI.AND.(.NOT.SPIX))) GO TO 485                   0413
284         REFDMD =REF1-XX                                            0414
285         GO TO 490                                                  0415
286   485   IF(.NOT.(SPIX.AND.(.NOT.SPI))) GO TO 492                  0416
287         IF(BR.AND.(.NOT.BRX)) GO TO 492                            0417
288         REFDMD = REF1                                              0418
289   490   ODMD = REFDMD                                              0419
290         LTEMP3=.TRUE.                                              0420
291   492   SPIX = SPI                                                 0421
292         BRX  = BR                                                  0422
293         IF(.NOT. LTEMP3) GO TO 500                                 0423
294         IF( RGT1(REFDMD,LLL) )GO TO 495
295         LLL=REFDMD                                                 0425
296         GO TO 500                                                  0426
297   495   IF( RGT1(REFDMD,HLL) ) HLL = REFDMD
298   C
299   C                    SET TM LOGIC
300   C
301   500   STM = OPRT .OR. ( .NOT. SPI .AND. .NOT. BR )
302         COIMGLOG(02) = .NOT. STM
303         IF(TM) VTTRACK = .FALSE.
304   C                                                                0429
305   C                    PERIODIC CCI SCAN LOGIC                     0430
306   C                                                                0431
307         DOIMGLOG(21) = PERSCAN
308         COIMGLOG(16) = PERSCAN
309   C
310   C                    ATC MESSAGE WRITER FAILURE
311   C
312         COIMGLOG(21) = SELTOUT
313   C
314   C                    A/I SYSTEM FAILURE
315   C
316         COIMGLOG(22) = VIDAROS
317   C                                                                0433
318   C                    INITIATE REMOTE TRANSFER LOGIC              0434
319   C                                                                0435
320         LTEMP2=.FALSE.                                             0436
321   C                                                                0437
```

LOGIC
PROGRAM 210 LISTING

```
322   C                    AS LOGIC                                          0438
323   C                                                                      0439
324         LTEMP1=(ASPB .AND. (.NOT. ATS)) .OR. (ATS .AND. ATSASPB)         0440
325         TSET=LTEMP1 .AND. DA .AND. (.NOT. BR) .AND. ASPERM .AND. GC      0441
326       1     .AND. (.NOT. PERSCAN)                                        0442
327         TCLR=(.NOT. TSET) .OR. CDL
328         AS=FF(TSET,TCLR,AS)                                              0444
329         IF(AS .AND. (.NOT. ASX)) LTEMP2=.TRUE.                           0445
330         ASPB=AS                                                          0446
331         ASX =AS                                                          0447
332         DOIMGLOG(15) = AS
333         COIMGLOG(11) = AS
334         COIMGLOG(12) = AS
335         LTEMP1=AS .AND. ASUP .AND. (.NOT. ASUPX)                         0451
336         IF(LTEMP1) ASINC=.TRUE.                                          0452
337         ASUPX=ASUP                                                       0453
338         LTEMP1=AS .AND. ASDOWN .AND. (.NOT. ASDOWNX)                     0454
339         IF(LTEMP1) ASDEC=.TRUE.                                          0455
340         ASDOWNX=ASDOWN                                                   0456
```

We claim:

1. A system for controlling the operation of a turbine power plant in accordance with monitored speed, said system comprising:

speed detection means;

a first conversion means governed by said detection means to generate both a first digital speed signal and a first analog speed signal;

a second conversion means similar to said first conversion means governed by said speed detection means to generate both a second digital speed signal and a second analog speed signal;

a third conversion means governed by said speed detection means to generate a third analog speed signal;

a first turbine controller governed by said first and second digital speed signals and said third analog speed signal to control the operation of the turbine below a predetermined speed level in accordance with a selected one of said first and second digital speed signals; and a second turbine controller governed by said first, second and third analog speed signals to control the operation of the turbine above a predetermined speed level in accordance with a selected one of said first and second analog speed signals.

2. A system according to claim 1 wherein the first turbine controller controls the operation of the turbine below a predetermined speed level in accordance with the other of either the first and second digital speed signals upon the detection of a malfunction as indicated by the selected digital speed signal only, whereby the first and second digital speed signals govern the first controller without preference.

3. A system according to claim 1 wherein the first controller includes speed monitoring means, comprising:

means to generate a malfunction signal at times when any one of the first and second digital speed signals and third analog speed signal differs from the other two of the three speed signals by a predetermined value or from a predetermined measurement range;

means governed by said generated malfunction signal to generate a transfer signal at times only when said generated malfunction signal is caused by the selected speed signal; and means governed by said transfer signal to select the other of the first and second speed signals for controlling turbine operation.

4. A system according to claim 3 wherein the first controller further controls the operation of the turbine in accordance with a speed error wherein said speed error is the algebraic difference of a speed reference signal and the selected digital speed signal.

5. A system according to claim 4 wherein the transfer signal generating means further includes means to maintain the speed error constant during selection of the other digital speed signal.

6. A system according to claim 1 wherein the second turbine controller controls the operation of the turbine above a predetermined speed level in accordance with the other of either the first and second analog speed signals upon the detection of a malfunction as indicated by the selected analog speed signal only, whereby the first and second analog speed signals govern the second controller without preference.

7. A system according to claim 1 wherein the second controller includes speed monitoring means, comprising:

means to generate a malfunction signal at times when one of either the first and second analog speed signals differ either from a predetermined measurement range or from the other two of the three analog speed signals by a predetermined value;

means governed by said generated malfunction signal to generate a transfer signal at times only when said generated malfunction is caused by the selected analog speed signal;

means governed by said transfer signal to select the other of the first and second analog speed signals for controlling turbine operation.

8. A system according to claim 7 wherein said means to generate a malfunction signal comprises:

means to compare both the first and second analog speed signals to predetermined limits;

means governed by the comparison means to generate an out-of-range signal for each of the first and second analog signals at times when a respective first and second analog signal is outside of said predetermined limits;

means governed by the first, second and third analog speed signals to generate a first and second departure signal, said first departure signal being indicative of the departure of the first analog speed signal from the other two of the three analog speed signals beyond a predetermined value and said second departure signal being indicative of the departure of the second analog speed signal from the other two of the three analog signals beyond a predetermined value; and means governed by said out-of-range and departure signals to generate the malfunctional signal.

9. A system according to claim 7 wherein the speed monitoring means further comprises:

means to generate a dual malfunction signal when at least two of the three analog speed signals indicates a malfunction;

means governed by said dual malfunction signal to generate a zero speed signal for rendering the second turbine controller unresponsive to the first and second analog speed signals.

10. A system for generating signals representative of turbine speed for use in control of turbine operation comprising:

speed detection means;

a first conversion means governed by said detection means to generate both a first digital speed signal and a first analog speed signal;

a second conversion means similar to said first conversion means governed by said speed detection means to generate both a second digital speed signal and a second analog speed signal;

a third conversion means governed by said speed detection means to generate a third analog speed signal;

a first means governed by said first and second digital speed signals and said third analog speed signal to select one of the first and second digital speed signals as being representative of turbine speed for use in control of turbine operation below a predetermined speed level;

a second means governed by said first, second and third analog speed signals to select one of said first and second analog speed signals as being representative of turbine speed for use in control of turbine operation above a predetermined speed level.

11. A system according to claim 10 wherein the first means selects the other of either the first and second digital speed signals upon the detection of a malfunction as indicated by the selected digital speed signal only, whereby the first and second digital speed signals are selected without preference as representative of turbine speed.

12. A system according to claim 10 wherein said first means comprises:

means to generate a malfunction signal in response to any one of the first and second digital speed signals and third analog speed signals departing in value from the other two of the three speed signals by a predetermined value or from a predetermined measurement range;

means governed by said generated malfunction signal to generate a transfer signal at times only when said generated malfunction signal is caused by the selected digital speed signal;

means governed by said transfer signal to select the other of the first and second digital speed signals as being representative of turbine speed.

13. A system according to claim 10 wherein the second means selects the other of either the first and second analog speed signals upon the detection of a malfunction as indicated by the selected analog speed signals only, whereby the first and second analog speed signals are selected without preference as representative of turbine speed.

14. A system according to claim 10 wherein the second means comprises:

means to generate a malfunction signal at times when only one of either the first and second analog speed signals differs either from a predetermined measurement range or from the other two of the three analog speed signals by a predetermined value;

means governed by said generated malfunction signal to generate a transfer signal at times only when said generated malfunction signal is caused by the selected analog speed signal; and means governed by the transfer signal to select the other of the first and second analog speed signals as being representative of turbine speed.

15. A system for controlling the operation of a turbine power plant above a predetermined speed level, said system comprising:

speed detector means;

conversion means governed by said detection means to generate first, second and third analog speed signals;

a turbine controller;

means governed by said first, second and third analog speed signals to control the operation of the turbine controller above a predetermined speed level in accordance with a selected one of said first and second analog speed signals;

means governed by said first, second and third analog speed signals to control the operation of the turbine controller in accordance with the other of either said first and second analog speed signals in response to the detection of a malfunction as indicated by said selected analog speed signal only, whereby said first and second analog speed signals govern the turbine controller without preference.

16. A system according to claim 15 wherein said turbine controller comprises:

means to generate a malfunction signal at times when only one of either the first and second analog speed signals differs either from a predetermined measurement range or from the other two of the three analog speed signals by a predetermined value;

means governed by said generated malfunction signal to generate a transfer signal at times only when said generated malfunction signal is caused by the selected analog speed signal; and means governed by the transfer signal to select the other of the first and second analog speed signals, whereby turbine operation is controlled in accordance with said other speed signal.

17. A system according to claim 15 wherein said turbine controller further comprises:

means to generate a dual malfunction signal when at least two of the three analog speed signals indicates a malfunction;

means governed by said dual malfunction signal to generate a zero speed signal for rendering the turbine controller unresponsive to the first and second analog speed signals.

* * * * *